US009534323B1

(12) United States Patent
Dubey et al.

(10) Patent No.: US 9,534,323 B1
(45) Date of Patent: Jan. 3, 2017

(54) TERRY FABRIC WEAVE AND RESULTING TERRY FABRIC

(71) Applicant: Trident Limited, Barnala (IN)

(72) Inventors: Manoranjan Kumar Dubey, Barnala (IN); Abhishek Gupta, Barnala (IN)

(73) Assignee: Trident Limited (IN)

( * ) Notice: Subject to any disclaimer, the term of this patent is extended or adjusted under 35 U.S.C. 154(b) by 0 days.

(21) Appl. No.: 15/189,363

(22) Filed: Jun. 22, 2016

(30) Foreign Application Priority Data

Jan. 9, 2016 (IN) ..... 201611000874

(51) Int. Cl.
*D03D 27/08* (2006.01)
*D03D 27/02* (2006.01)
*D03D 27/00* (2006.01)

(52) U.S. Cl.
CPC ..... *D03D 27/08* (2013.01); *D03D 27/02* (2013.01)

(58) Field of Classification Search
CPC ..... D03D 27/08; D03D 27/10; D03D 27/02; D03D 27/06; D03D 39/00; D03D 39/22; D03D 15/00; D03D 1/00; D03D 25/00; D03D 2700/0155; D03D 2700/017; D03D 27/00; D03D 39/20
See application file for complete search history.

(56) References Cited

U.S. PATENT DOCUMENTS 350,372 A * 10/1886 Leake ..... D03D 27/08 139/396
376,664 A * 1/1888 Leake ..... D03D 27/08 139/396
1,398,752 A * 11/1921 Taylor ..... D03D 27/08 139/396
1,830,892 A * 11/1931 Talbirt ..... D03D 27/08 139/396
3,030,691 A * 4/1962 Law ..... D03D 27/08 139/396
3,065,520 A * 11/1962 Schmidt ..... D03D 25/00 139/391
3,169,557 A * 2/1965 Holland ..... D03D 1/00 139/383 R
3,302,665 A * 2/1967 McHargue ..... D03D 27/08 139/25
3,602,264 A * 8/1971 Tiernan ..... D03D 27/08 139/25
3,625,260 A * 12/1971 Troy ..... D03D 39/00 139/402
3,779,286 A * 12/1973 Pfarrwaller ..... D03D 39/223 139/25
3,900,051 A * 8/1975 Bucher ..... D03D 27/08 139/102
4,368,760 A * 1/1983 Frommert ..... D03C 7/02 139/397
4,381,805 A * 5/1983 Troy ..... D03D 27/00 139/391

(Continued)

*Primary Examiner* — Bobby Muromoto, Jr.
(74) *Attorney, Agent, or Firm* — Lerner, David, Littenberg, Krumholz & Mentlik, LLP

(57) ABSTRACT

A terry fabric having a plurality of longitudinally oriented ground warp yarns pairs, a plurality of longitudinally oriented pile warp yarns, and a plurality of weft yarns oriented substantially perpendicular to the ground warp yarn pairs. The terry fabric includes a repeated weave sequence comprising first and second interlacing arrangements.

16 Claims, 13 Drawing Sheets

(56) References Cited

U.S. PATENT DOCUMENTS

| | | | | | |
|---|---|---|---|---|---|
| 4,526,209 | A * | 7/1985 | Pharr | D03D 39/20 | 139/21 |
| 5,308,009 | A * | 5/1994 | Mizuno | G03B 17/26 | 156/293 |
| 5,447,182 | A * | 9/1995 | Gehrig | D03D 39/22 | 139/25 |
| 5,458,160 | A * | 10/1995 | Geiger | D03D 39/22 | 139/102 |
| 5,771,943 | A * | 6/1998 | Carlson | D03D 27/02 | 139/39 |
| 6,253,797 | B1 * | 7/2001 | Vogel | D03D 27/08 | 139/25 |
| 6,305,431 | B1 * | 10/2001 | Fenkes | A47L 13/16 | 139/391 |
| 6,945,280 | B2 * | 9/2005 | Debaes | D03D 39/16 | 139/116.5 |
| 7,111,648 | B2 * | 9/2006 | Mitchell | D03D 27/08 | 139/391 |
| 7,287,552 | B2 * | 10/2007 | Debaes | D03D 27/10 | 139/191 |
| 7,762,286 | B1 * | 7/2010 | Speaks | D03D 27/08 | 139/21 |
| 2004/0084101 | A1 * | 5/2004 | Debaes | D03D 39/16 | 139/2 |
| 2005/0178458 | A1 * | 8/2005 | Mitchell | D03D 27/08 | 139/396 |
| 2006/0137758 | A1 * | 6/2006 | Debaes | D03D 27/10 | 139/11 |
| 2008/0230140 | A1 * | 9/2008 | Santens | D03D 15/00 | 139/396 |
| 2012/0076971 | A1 * | 3/2012 | Debnath | D02G 3/04 | 428/85 |
| 2014/0338783 | A1 * | 11/2014 | Debaes | D03D 27/10 | 139/21 |

* cited by examiner

1500B

TABLE A

| Parameters | Terry Fabric A (4 Pick Terry Fabric In Accordance With The Present Invention) | Terry Fabric B (4 Pick Terry Fabric In Accordance With Prior Art Weave Sequence) | Terry Fabric C (3 Pick Terry Fabric In Accordance With A Prior Art Weave Sequence) | Terry Fabric D (4 Pick Terry Fabric In Accordance With A Prior Art Weave Sequence) | Terry Fabric E (5 Pick Terry Fabric In Accordance With The Present Invention) |
|---|---|---|---|---|---|
| Grams/Square Meter (GSM) (Towel Average) | 680 | 680 | 680 | 750 | 680 |
| Pick/cm | 20 | 10.8 | 14 | 18.5 | 25.5 |
| Pile height (mm) | 6.69 | 6.68 | 3.74 | 7.09 | 7.15 |
| Pile Count (Ne) | 2/09 CW | 2/09 CW | 2/09 CW | 2/20 CW | 2/09 CW |
| Ground Count (Resultant Ne) | 10 | 10 | 10 | 10 | 10 |
| Weft Count (Ne) | 12 | 12 | 12 | 12 | 12 |
| Loop density / dm | 1887 | 2214 | 2869 | 3792 | 2406 |
| Drawing | 2 Ground 1 Pile | 2 Ground 2 Pile | 2 Ground 2 Pile | 2 Ground 2 Pile | 2 Ground 1 Pile |
| Cover Factor (Weft) | 14.66 | 7.92 | 10.27 | 13.56 | 18.70 |
| Pile Yarn per inch | 10.50 | 28.00 | 28.00 | 28.00 | 10.50 |
| Absorbency (ASTM D4772) After 1 Wash | 86% | 86% | 80% | 87% | 84% |
| Tensile Strength (in lbf) (Weft) ASTM D5034 | 67.1 | 36.2 | 63.8 | 71.1 | 73.5 |

FIGURE 16

TERRY FABRIC WEAVE AND RESULTING TERRY FABRIC

FIELD OF THE INVENTION

The present invention relates to terry fabric weaves, methods for weaving terry fabrics comprising such weaves, and resulting terry fabrics. In particular, the invention relates to terry fabrics having improved material efficiencies, pull resistance, absorbency, softness and uniformity of texture.

BACKGROUND

Terry fabrics are manufactured for several different end uses, including as towels, bathrobes, blankets, cleaning products, carpets and the like. Terry fabrics are considered advantageous in view of the fast drying, softness, ability to pick up particles, and ability to absorb moisture.

Terry fabrics typically comprise a woven ground fabric comprising a plurality of substantially parallel ground warp yarns and a plurality of substantially parallel ground weft yarns (or picks)—wherein the plurality of ground weft yarns intersect the plurality of ground warp yarns substantially perpendicularly. Additionally, a plurality of pile warp yarns are interwoven into the ground fabric in a direction substantially parallel to the ground warp yarns—and the pile weave forms a plurality of pile loops or terry loops above and below the woven ground fabric.

Ground warp yarns are interwoven with ground weft yarns at a relatively high tension and forms the base or substrate of the terry fabric. The pile warp yarns are interwoven at a lower tension and are advanced or "let off" from the loom beam at a higher rate than the ground warp yarns. During weaving, a series of adjacent ground weft yarns are subjected to a partial beat-up or "loose beat-up", where the weft yarn(s) may be pushed partially together using a comb (or "reed") or where the fell of the cloth is moved forward to enable a partial beat-up, while the pile warp yarns are permitted to "float" over two or more adjacent ground weft yarns. On an ensuing ground weft yarn (at the conclusion of a weaving repeat), the previously partially beat up ground weft yarns as well as the ensuing ground weft yarn are subjected to a "fast beat up", where all ground weft yarns are pushed fully up to the fell of the woven fabric—resulting in the floating pile threads forming loops that extend away from the ground substrate. A common terry pattern comprises a 3 pick sequence, wherein pile loops are interwoven into the ground fabric in a repeating pattern such that pile loops are formed using (and repeated every) 3 ground weft yarns. Less commonly known are 4, 5, 6 and 7 pick sequences—where interweaving a pile yarn into the ground fabric comprises repeating a pile loop every 4, 5, 6, or 7 ground weft yarns.

FIGS. 1 and 2 respectively provide transverse and perspective views of a terry weave sequence 100 comprising a 3 pick sequence. Terry weave sequence 100 comprises a pair of ground warp yarns 102*a* and 102*b* interwoven with a plurality of ground weft yarns in a repeating sequence such that first and second ground weft yarns 104*a* and 104*b* are placed within a first shed 106*a* formed by the pair of ground warp yarns, and a third ground weft yarn 104*c* is placed within a second shed 106*b* formed by the pair of ground warp yarns. Said repeating sequence forms a ground fabric on ground substrate terry weave sequence 100 additionally comprises pile yarns 108*a* and 108*b* wherein each of said pile yarns are interwoven into the ground substrate in a sequence that repeats every 3 ground weft yarns. The 3 pick sequence can be observed in case of pile loop 110*a* which is formed over the sequence of ground weft yarns 104*a*, 104*b* and 104*c*, and in case of pile loop 110*b* which is also formed over the sequence of ground weft yarns 104*a*, 104*b* and 104*c*. It would be understood from FIGS. 1 and 2 that in forming pile loop 110*a*, pile yarn 108*a* passes between ground weft yarns 104*a* and 104*b* and thereafter forms a pile loop over ground weft yarns 104*b* and 104*c* (i.e. on the top surface/face surface of the ground substrate), before the next 3 pick sequence is commenced. Likewise, in forming pile loop 110*b*, pile yarn 108*b* passes between ground weft yarns 104*a* and 104*b* and thereafter forms a pile loop over ground weft yarns 104*b* and 104*c* (i.e. on the bottom surface/back surface of the ground substrate), before the next 3 pick sequence is commenced.

While prior art weave sequences have been widely used in the past, it is desired to increase pick density of terry fabrics beyond the pick densities permitted by prior art weave sequences, as well as to improve pull resistance, absorbency, softness and uniformity of texture of the terry fabrics.

SUMMARY

The invention provides a terry fabric comprising a plurality of longitudinally oriented ground warp yarns pairs, a plurality of longitudinally oriented pile warp yarns, and a plurality of weft yarns oriented substantially perpendicular to the ground warp yarn pairs. The terry fabric comprises a repeated weave sequence, said repeated weave sequence comprising a first interlacing arrangement comprising a first ground warp yarn pair and a first pile warp yarn interlaced adjacent to and in contact with at least one yarn within the first ground warp yarn pair, the first interlacing arrangement comprising (a) first, second and third weft yarns positioned within a first shed formed by the first ground warp yarn pair, (b) a fourth weft yarn positioned within a second shed formed by the first ground warp yarn pair, wherein the second and third weft yarns are positioned between the first and fourth weft yarns, (c) fifth, sixth and seventh weft yarns positioned within a third shed formed by the first ground warp yarn pair, (d) an eighth weft yarn positioned within a fourth shed formed by the first ground warp yarn pair, wherein the sixth and seventh weft yarns are positioned between the fifth and eighth weft yarns, (f) a first pile loop formed by the first pile yarn, wherein said first pile loop is formed over the first, second, third and fourth weft yarns on one of a face surface or a back surface of a ground substrate, (g) a first region on a surface of the ground substrate that is opposite to the surface on which the first pile loop is formed, said first region having boundaries defined by (I) the first ground warp yarn pair, (II) a second ground warp yarn pair adjacent to the first ground warp yarn pair, (III) the first weft yarn and (IV) the fourth weft yarn, wherein said first region is free of pile loop formation, (h) a second pile loop formed by the first pile yarn, wherein said second pile loop is formed over the fifth, sixth, seventh and eighth weft yarns on one of the face surface or the back surface of the ground substrate, (i) a second region on a surface of the ground substrate that is opposite to the surface on which the second pile loop is formed, said second region having boundaries defined by (I) the first ground warp yarn pair, (II) the second ground warp yarn pair, (III) the fifth weft yarn and (IV) the eighth weft yarn, wherein said second region is free of pile loop formation;

The repeated weave sequence additionally comprises a second interlacing arrangement comprising the second ground warp yarn pair and a second pile warp yarn interlaced adjacent to and in contact with at least one yarn within the second ground warp yarn pair. The second interlacing arrangement additionally comprises (a) the first, second and third weft yarns positioned within a fifth shed formed by the second ground warp yarn pair, (b) the fourth weft yarn positioned within a sixth shed formed by the second ground warp yarn pair, (c) the fifth, sixth and seventh weft yarns positioned within a seventh shed formed by the second ground warp yarn pair, (d) the eighth weft yarn positioned within an eighth shed formed by the second ground warp yarn pair, (e) a third pile loop formed by the second pile yarn, wherein said third pile loop is formed over the first, second, third and fourth weft yarns on one of the face surface or the back surface of the ground substrate, (f) a third region on a surface of the ground substrate that is opposite to the surface on which the third pile loop is formed, said third region having boundaries defined by (I) the second ground warp yarn pair, (II) a third ground warp yarn pair adjacent to the second ground warp yarn pair and positioned such that the second ground warp yarn pair is interposed between the third ground warp yarn pair and the first ground warp yarn pair, (III) the first weft yarn and (IV) the fourth weft yarn, wherein said third region is free of pile loop formation, (g) a fourth pile loop formed by the second pile yarn, wherein said fourth pile loop is formed over the fifth, sixth, seventh and eighth weft yarns on one of the face surface or the back surface of the ground substrate, and (h) a fourth region on a surface of the ground substrate that is opposite to the surface on which the fourth pile loop is formed, said fourth region having boundaries defined by (I) the second ground warp yarn pair, (II) the third ground warp yarn pair, (III) the fifth weft yarn and (IV) the eighth weft yarn, wherein said fourth region is free of pile loop formation.

Further, in the repeated weave sequence, one of the first pile loop and the third pile loop is formed on the face surface of the ground substrate, and the other of the first pile loop and the third pile loop is formed on the back surface of the ground substrate. Additionally, one of the second pile loop and the fourth pile loop is formed on the face surface of the ground substrate, and the other of the second pile loop and the fourth pile loop is formed on the back surface of the ground substrate.

In an embodiment of the terry fabric, the repeated weave sequence may ensure one or more of, positioning the second shed adjacent to the first shed, positioning the third shed adjacent to the second shed, positioning the fourth shed adjacent to the third shed, positioning the sixth shed adjacent to the fifth shed, positioning the seventh shed adjacent to the sixth shed, and positioning the eighth shed adjacent to the seventh shed.

The repeated weave sequence may also ensures that at least one additional weft yarn is positioned between any of the second shed and the first shed, the third shed and the second shed, the fourth shed and the third shed, the sixth shed and the fifth shed, the seventh shed and the sixth shed, or the eighth shed and the seventh shed.

Any of the first shed, third shed, fifth shed or seventh shed may have more than three weft yarns positioned therewithin. Any one of the second shed, fourth shed, sixth shed or eighth shed may have more than one weft yarn positioned therewithin.

In an embodiment, in the first interlacing arrangement, the first pile loop and the second pile loop may be formed on opposite surfaces of the ground substrate, while in the second interlacing arrangement, the third pile loop and the fourth pile loop may be formed on opposite surfaces of the ground substrate.

In an embodiment, in the first interlacing arrangement, the first pile loop and the second pile loop may be formed on one of the face surface or the back surface of the ground substrate, while in the second interlacing arrangement, the third pile loop and the fourth pile loop may be formed on the other of the face surface or the back surface of the ground substrate.

The first ground warp yarn pair and the second ground warp yarn pair may be adjacent yarn pairs, having only a single pile yarn interposed therebetween. Alternately, the first ground warp yarn pair and the second ground warp yarn pair may have at least one additional ground warp yarn pair interposed therebetween.

In an embodiment of the terry fabric, a plurality of instances of the repeated weave sequences may be implemented within the terry fabric. In a specific embodiment, a first instance of the repeated weave sequence may be located immediately adjacent to a second instance of the repeated weave sequence.

In an embodiment of the terry fabric, the first pile warp yarn and the second pile warp yarn may be adjacent pile warp yarns.

The first pile yarn or the second pile yarn may be interlaced into the ground substrate in a repeating sequence that forms each pile loop over 4 or more weft yarns. In a more specific embodiment, the first pile yarn or the second pile yarn may be interlaced into the ground substrate in a repeating sequence that forms each pile loop over 4 to 6 weft yarns.

The invention additionally provides a method of manufacturing a terry fabric comprising a plurality of longitudinally oriented ground warp yarns pairs, a plurality of longitudinally oriented pile warp yarns, and a plurality of weft yarns oriented substantially perpendicular to the ground warp yarn pairs. The method comprises weaving a terry fabric using a plurality of instances of a repeated weave sequence.

Weaving each repeated weave sequence comprises weaving a first interlacing arrangement comprising a first ground warp yarn pair and a first pile warp yarn interlaced adjacent to and in contact with at least one yarn within the first ground warp yarn pair, comprising the steps of (a) placement of first, second and third weft yarns within a first shed formed by the first ground warp yarn pair, (b) placement of a fourth weft yarn within a second shed formed by the first ground warp yarn pair, wherein the second and third weft yarns are positioned between the first and fourth weft yarns, (c) placement of fifth, sixth and seventh weft yarns within a third shed formed by the first ground warp yarn pair, (d) placement of an eighth weft yarn within a fourth shed formed by the first ground warp yarn pair, wherein the sixth and seventh weft yarns are positioned between the fifth and eighth weft yarns, (e) forming a first pile loop, wherein said first pile loop is formed with the first pile yarn, and wherein said first pile loop is formed over the first, second, third and fourth weft yarns, on one of a face surface or a back surface of a ground substrate (f) forming a first region on a surface of the ground substrate that is opposite to the surface on which the first pile loop is formed, said first region having boundaries defined by (I) the first ground warp yarn pair, (II) a second ground warp yarn pair adjacent to the first ground warp yarn pair, (III) the first weft yarn and (IV) the fourth weft yarn, wherein said first region is free of pile loop formation, (g) forming a second pile loop, wherein said second pile loop is formed by the first pile yarn, and wherein said second pile loop is formed over the fifth, sixth, seventh and eighth weft yarns, on one of the face surface or the back surface of the ground substrate, (h) forming a second region on a surface of the ground substrate that is opposite to the surface on which the second pile loop is formed, said second region having boundaries defined by (I) the first ground warp yarn pair, (II) the second ground warp yarn pair, (III) the fifth weft yarn and (IV) the eighth weft yarn, wherein said second region is free of pile loop formation.

Weaving each repeated weave sequence additionally comprises weaving a second interlacing arrangement comprising the second ground warp yarn pair and a second pile warp yarn interlaced adjacent to and in contact with at least one yarn within the second ground warp yarn pair, comprising the steps of (a) placement of the first, second and third weft yarns within a fifth shed formed by the second ground warp yarn pair, (b) placement of the fourth weft yarn within a sixth shed formed by the second ground warp yarn pair, (c) placement of the fifth, sixth and seventh weft yarns within a seventh shed formed by the second ground warp yarn pair, (d) the eighth weft yarn positioned within an eighth shed formed by the second ground warp yarn pair, (e) forming a third pile loop, wherein said third pile loop is formed by the second pile yarn, and wherein said third pile loop is formed over the first, second, third and fourth weft yarns, on one of the face surface or the back surface of the ground substrate, (f) forming a third region on a surface of the ground substrate that is opposite to the surface on which the third pile loop is formed, said third region having boundaries defined by (I) the second ground warp yarn pair, (II) a third ground warp yarn pair adjacent to the second ground warp yarn pair and positioned such that the second ground warp yarn pair is interposed between the third ground warp yarn pair and the first ground warp yarn pair, (III) the first weft yarn and (IV) the fourth weft yarn, wherein said third region is free of pile loop formation, (g) forming a fourth pile loop, wherein said fourth pile loop formed by the second pile yarn, and wherein said fourth pile loop is formed over the fifth, sixth, seventh and eighth weft yarns on one of the face surface or the back surface of the ground substrate, (h) forming a fourth region on a surface of the ground substrate that is opposite to the surface on which the fourth pile loop is formed, said fourth region having boundaries defined by (I) the second ground warp yarn pair, (II) the third ground warp yarn pair, (III) the fifth weft yarn and (IV) the eighth weft yarn, wherein said fourth region is free of pile loop formation.

The method of weaving each repeated sequence may additionally ensure that (a) one of the first pile loop and the third pile loop is formed on the face surface of the ground substrate, and the other of the first pile loop and the third pile loop is formed on the back surface of the ground substrate, and (b) one of the second pile loop and the fourth pile loop is formed on the face surface of the ground substrate, and the other of the second pile loop and the fourth pile loop is formed on the back surface of the ground substrate.

In an embodiment of the invention, the method of manufacturing the terry fabric additionally comprises shearing one or more of the first pile loop, second pile loop, third pile loop and/or fourth pile loop, to generate cut tufted pile tuft on at least one surface of the ground substrate.

BRIEF DESCRIPTION OF THE ACCOMPANYING DRAWINGS

FIGS. 1 and 2 respectively provide transverse and perspective views of prior art 3 pick repeating terry weave sequences.

FIG. 16 is a table setting out the results of a comparative analysis of fabrics manufactured in accordance with the present invention against fabrics manufactured in accordance with terry weave sequences previously known in the art.

DETAILED DESCRIPTION

The present invention comprises a terry fabric weave sequence, resulting terry fabric and a method for manufacturing a terry fabric implementing the specific terry fabric weave sequence. In particular the terry fabric weave sequence of the present invention comprises a repeating weave sequence that has been found to be significantly advantageous in comparison with prior art terry weaves.

For the purposes of the present invention each terry fabric weave sequence comprises a plurality of longitudinally oriented ground warp yarn pairs, a plurality of pile warp yarns interwoven in parallel with the ground warp yarn pairs, and a plurality of weft yarns oriented substantially perpendicular to the ground warp yarn pairs. The terry weave sequence is a repeating weave sequence, wherein each repeated weave sequence comprises of first and second interlacing arrangement.

An embodiment of the terry weave sequence of the present invention is explained in detail below with reference to FIGS. 3, 4 and 5.

Figure 1:
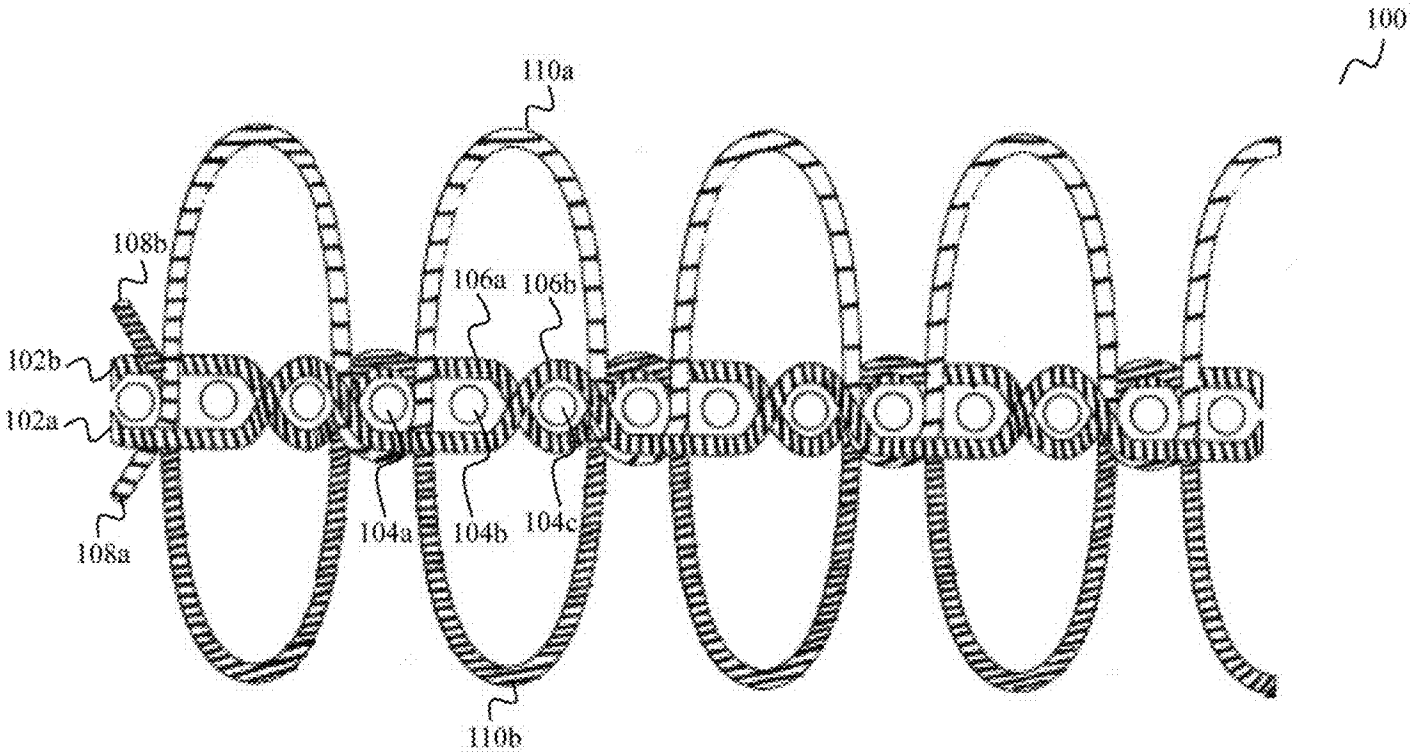
Figure 2:
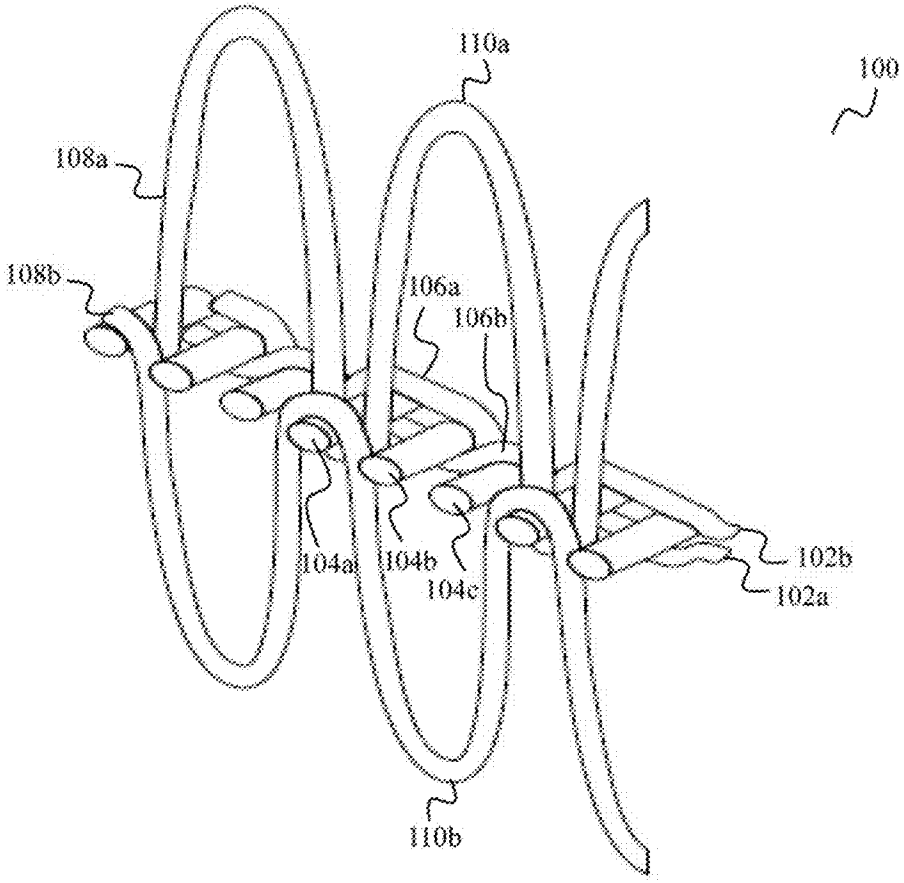
Figure 4:
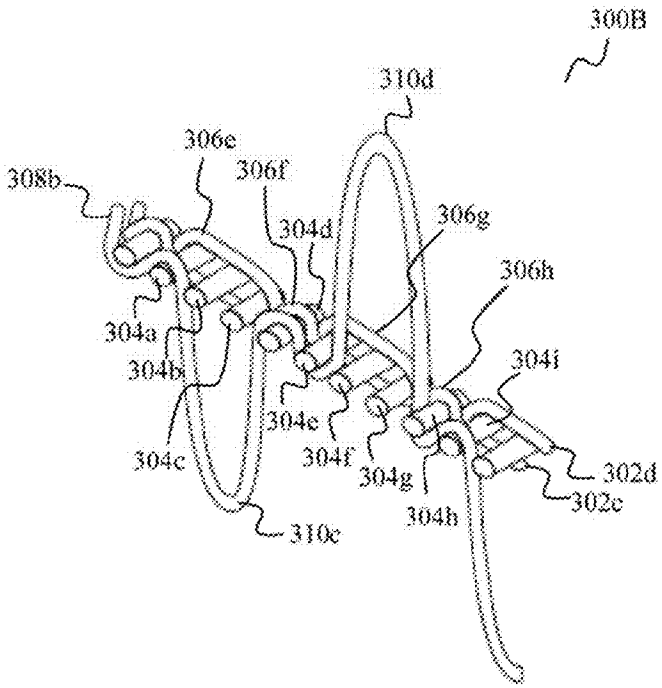
FIGS. 3, 4 and 5 illustrate a terry weave having a 4 pick repeating sequence in accordance with the present invention.
Figure 3:
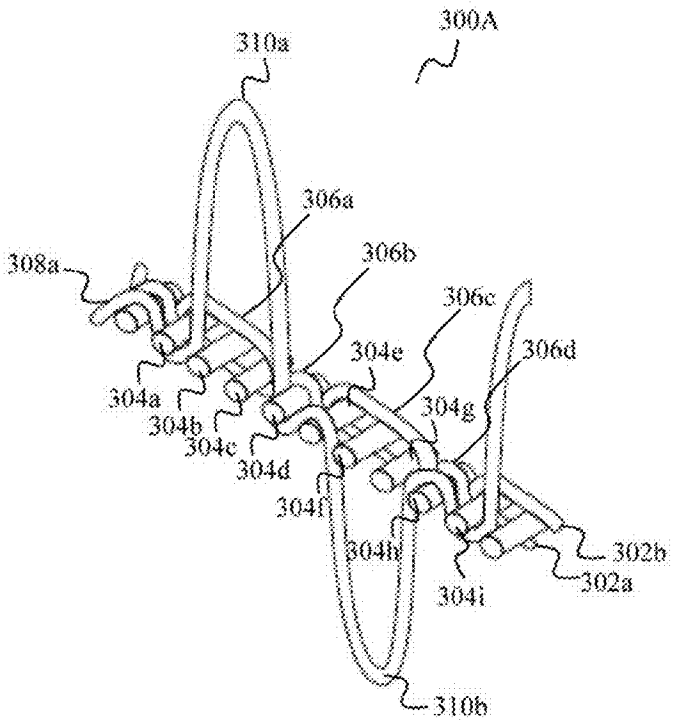

FIGS. 3 and 4 respectively illustrate first and second interlacing arrangements that are incorporated within a terry weave sequence in accordance with the present invention. FIG. 3 illustrates a first interlacing arrangement, FIG. 4 illustrates a second interlacing arrangement. FIG. 5 illustrates the terry weave sequence incorporating both the first interlacing arrangement and the second interlacing arrangement.

FIG. 3 illustrates a first interlacing arrangement 300A comprising a first ground warp yarn pair 302*a*, 302*b*, a first pile warp yarn 308*a*, and a plurality of ground weft yarns 304*a* to 304*h*. The first ground warp yarn pair comprises warp yarns 302*a* and 302*b* that are interlaced and positioned adjacent to first pile warp yarn 308*a*. The first ground warp yarn pair 302*a*, 302*b* is interlaced with ground weft yarns such that first weft yarn 304*a*, second weft yarn 304*b* and third weft yarn 304*c* are positioned within a first shed 306*a* formed by first ground warp yarn pair 302*a* and 302*b*. Additionally, a fourth weft yarn 304*d* is positioned within a second shed 306*b* formed by first ground warp yarn pair 302*a* and 302*b*. A fifth weft yarn 304*e*, sixth weft yarn 304*f* and seventh weft yarn 304*g* are positioned within a third shed 306*c* formed by first ground warp yarn pair 302*a* and

302*b*. Additionally, an eighth weft yarn 304*h* is positioned within a fourth shed 306*d* formed by first ground warp yarn pair 302*a* and 302*b*. Eighth weft yarn 304*h* is followed by immediately adjacent weft yarn 304*i* (adjacent weft yarn 304*i* forms part of a next instance of the first interlacing arrangement within a repeating sequence).

First pile warp yarn 308*a* is interlaced within first interlacing arrangement 300A so as to form a first pile loop 310*a* and a second pile loop 310*b*. First pile loop 310*a* is formed over first weft yarn 304*a*, second weft yarn 304*b*, third weft yarn 304*c* and fourth weft yarn 304*d*. More specifically first pile loop 310*a* is formed by passing first pile warp yarn 308*a* (i) between first weft yarn 304*a* and second weft yarn 304*b*, (ii) over second weft yarn 304*b* and third weft yarn 304*c* in a loop (formed on a top surface/face surface of the ground substrate), (iii) between third weft yarn 304*c* and fourth weft yarn 304*d*, and (iv) between fourth weft yarn 304*d* and fifth weft yarn 304*e*. Likewise, second pile loop 310*b* is formed over fifth weft yarn 304*e*, sixth weft yarn 304*f*, seventh weft yarn 304*g* and eighth weft yarn 304*h*. Specifically, second pile loop 310*b* is formed by passing first pile warp yarn 308*a* (i) between fifth weft yarn 304*e* and sixth weft yarn 304*f*, (ii) over sixth weft yarn 304*f* and seventh weft yarn 304*g* in a loop (formed on a bottom surface/back surface of the ground substrate), (iii) between seventh weft yarn 304*g* and eighth weft yarn 304*h*, and (iv) between eighth weft yarn 304*h* and ninth weft yarn 304*i*.

FIG. 4 illustrates a second interlacing arrangement 300B comprising a second ground warp yarn pair 302*c*, 302*d*, and a second pile warp yarn 308*b*, respectively interlaced through ground weft yarns 304*a* to 304*h*. The second ground warp yarn pair comprises warp yarns 302*c* and 302*d* that are interlaced and positioned adjacent to second pile warp yarn 308*b*. The second ground warp yarn pair 302*c*, 302*d* is interlaced with ground weft yarns such that first weft yarn 304*a*, second weft yarn 304*b* and third weft yarn 304*c* are positioned within a fifth shed 306*e* formed by second ground warp yarn pair 302*c* and 302*d*. Fourth weft yarn 304*d* is positioned within a sixth shed 306*f* formed by second ground warp yarn pair 302*c* and 302*d*. Fifth weft yarn 304*e*, sixth weft yarn 304*f* and seventh weft yarn 304*g* are positioned within a seventh shed 306*g* formed by second ground warp yarn pair 302*c* and 302*d*. Eighth weft yarn 304*h* is positioned within an eighth shed 306*h* formed by second ground warp yarn pair 302*c* and 302*d*.

Second pile warp yarn 308*b* is interlaced within second interlacing arrangement 300B so as to form a third pile loop 310*c* and a fourth pile loop 310*d*. Third pile loop 310*c* is formed over first weft yarn 304*a*, second weft yarn 304*b*, third weft yarn 304*c* and fourth weft yarn 304*d*. More specifically, third pile loop 310*c* is formed by passing second pile warp yarn 308*b* (i) between first weft yarn 304*a* and second weft yarn 304*b*, (ii) over second weft yarn 304*b* and third weft yarn 304*c* in a loop (formed on a bottom surface/back surface of the ground substrate), (iii) between third weft yarn 304*c* and fourth weft yarn 304*d* and (iv) between fourth weft yarn 304*d* and fifth weft yarn 304*e*. Likewise, fourth pile loop 310*d* is formed over fifth weft yarn 304*e*, sixth weft yarn 304*f*, seventh weft yarn 304*g* and eighth weft yarn 304*h*. Specifically, fourth pile loop 310*d* is formed by passing second pile warp yarn 308*b* (i) between fifth weft yarn 304*e* and sixth weft yarn 304*f*, (ii) over sixth weft yarn 304*f* and seventh weft yarn 304*g* in a loop (formed on a top surface/face surface of the ground substrate), (iii) between seventh weft yarn 304*g* and eighth weft yarn 304*h* and (iv) between eighth weft yarn 304*h* and a ninth weft yarn 304*i*.

Figure 5:
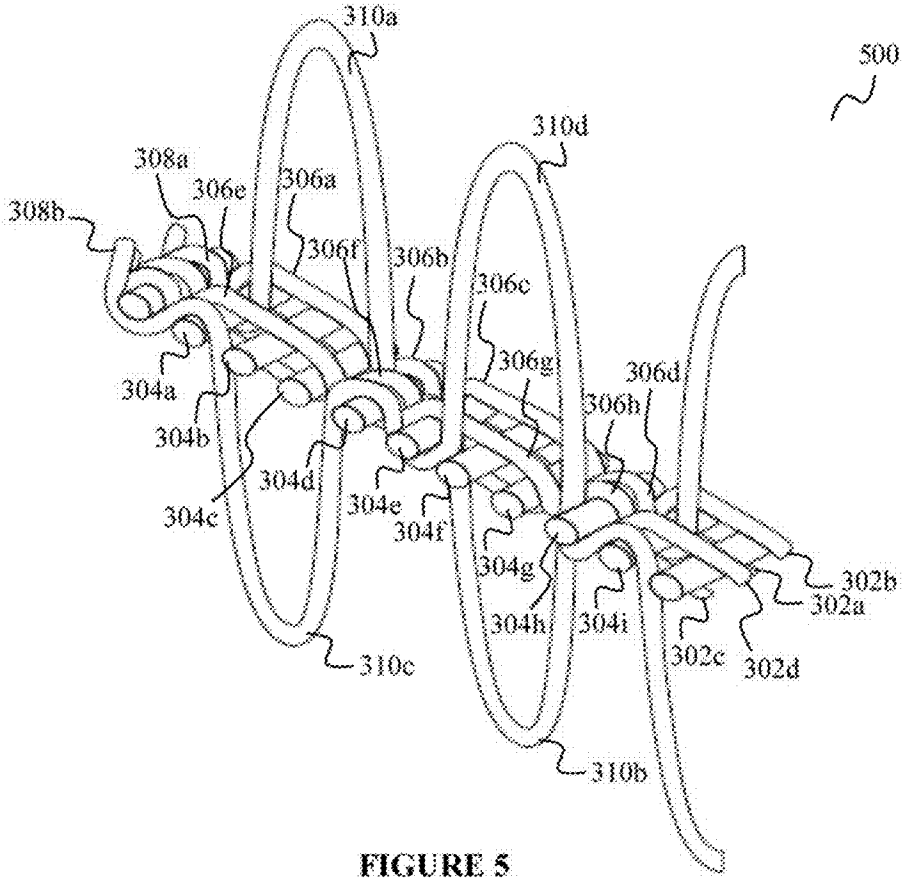

FIG. 5 illustrates a terry weave sequence 500 in accordance with the present invention, wherein, first interlacing arrangement 300A (as illustrated in FIG. 3) and second interlacing arrangement 300B (as illustrated in FIG. 4) are incorporated within terry weave sequence 500.

As illustrated in FIG. 5, first pile loop 310*a* is formed on a face surface of the ground substrate (i.e. the ground fabric comprising interwoven warp and weft yarns). Simultaneously the opposite surface (i.e. the back surface) of the ground substrate comprises a first region having boundaries defined by (a) first ground warp yarn pair 302*a*, 302*b*, (b) second ground warp yarn pair 302*c*, 302*d*, (c) first weft yarn 304*a* and (d) fourth weft yarn 304*d*—which first region is devoid or free of pile loop formation (i.e. no pile loop is formed over this region on said back surface of the ground substrate).

Likewise, second pile loop 310*b* is formed on a back surface of the ground substrate. Simultaneously an opposite surface (i.e. the face surface) of the ground substrate comprises a second region having boundaries defined by (a) first ground warp yarn pair 302*a*, 302*b*, (b) second ground warp yarn pair 302*c*, 302*d*, (c) fifth weft yarn 304*e* and (d) eighth weft yarn 304*h*—which second region is devoid or free of pile loop formation (i.e. no pile loop is provided in this region on said face surface of the ground substrate).

Additionally, as illustrated in FIG. 5, third pile loop 310*c* is formed on a back surface of the ground substrate. Simultaneously an opposite surface of the ground substrate (i.e. the face surface) comprises a third region having boundaries defined by (a) second ground warp yarn pair 302*c*, 302*d*, (b) a third ground warp yarn pair (not shown in FIG. 5) that is adjacent to second ground warp yarn pair 302*c*, 302*d*, and which is positioned such that second ground warp yarn pair 302*c*, 302*d* is interposed between said third ground warp yarn pair and first ground warp yarn pair 302*a*, 302*b*, (c) first weft yarn 304*a* and (d) fourth weft yarn 304*d*—which third region is devoid or free of pile loop formation (i.e. no pile loop is formed over this region on the face surface of the ground substrate).

Likewise, fourth pile loop 310*d* is formed on a face surface of the ground substrate. Simultaneously an opposite surface (i.e. the back surface) of the ground substrate comprises a fourth region having boundaries defined by (a) second ground warp yarn pair 302*c*, 302*d*, (b) the third ground warp yarn pair, (c) fifth weft yarn 304*e* and (d) eighth weft yarn 304*h*—which fourth region is devoid or free of pile loop formation (i.e. no pile loop is formed over this region on back surface of the ground substrate).

Additionally, as is apparent from weave sequence 500 as illustrated in FIG. 5, first pile loop 310*a* and third pile loop 310*c* are respectively formed on opposite surfaces of the ground substrate, while second pile loop 310*b* and fourth pile loop 310*d* are respectively formed on opposite surfaces of the ground substrate.

The terry weave sequence 500 illustrated in FIG. 5 shows first ground warp yarn pair 302*a*, 302*b* positioned adjacent to second ground warp yarn pair 302*c*, 302*d* with only first pile yarn 308*a* interposed therebetween. For the purposes of the present invention however, one or more additional ground warp yarn pairs may be interposed between first ground warp yarn pair 302*a*, 302*b* and second ground warp yarn pair 302*c*, 302*d*—provided however that no other pile yarn (i.e. no pile yarn other than first pile yarn 308*a*) is interposed between first ground warp yarn pair 302*a*, 302*b* and second ground warp yarn pair 302*c*, 302*d*.

The illustrations in FIGS. 3 to 5 illustrate embodiments of the terry weave sequence where first pile yarn 308*a* forms pile loops alternately on face and back surfaces of the ground substrate, while second pile yarn 308*b* also forms pile loops alternately on face and back surfaces of the ground substrate. In another embodiment of the invention, illustrated in FIGS. 6, 7 and 8, the first pile yarn may form pile loops on only one of the face or back surface of the ground substrate while the second pile yarn may form pile loops on only the other of the face or back surface of the ground substrate.

Figure 7:
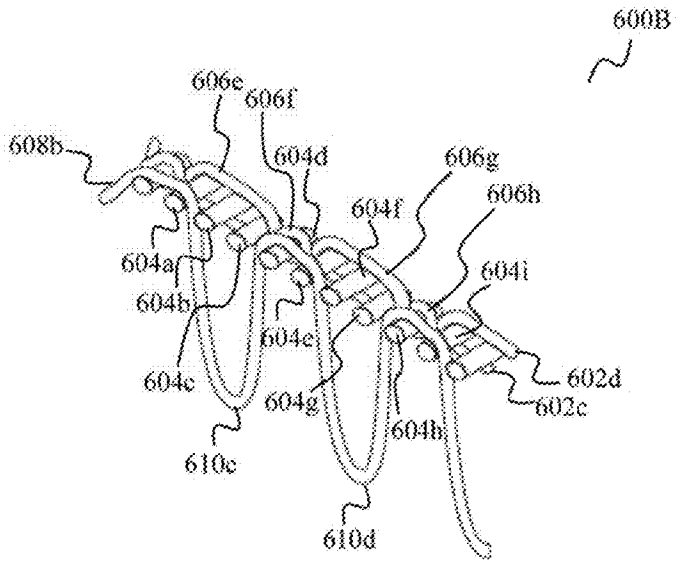
FIGS. 6, 7 and 8 illustrate perspective and transverse views of another terry weave having a 4 pick repeating sequence in accordance with the present invention.
Figure 6:
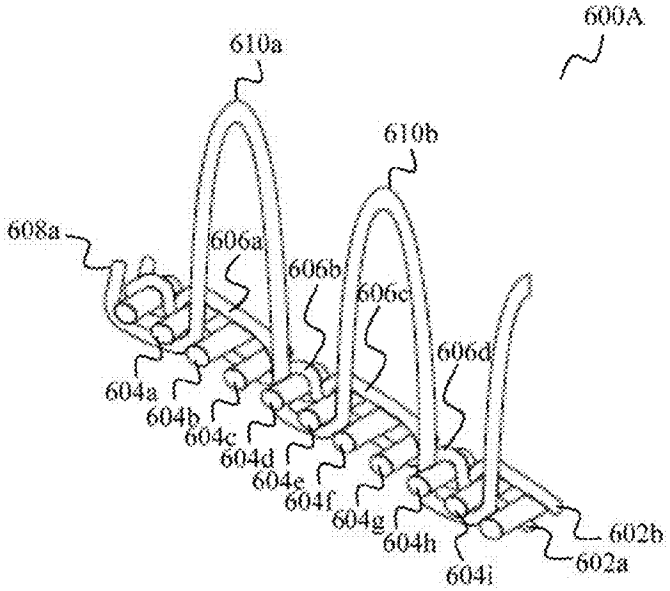
Figure 8:
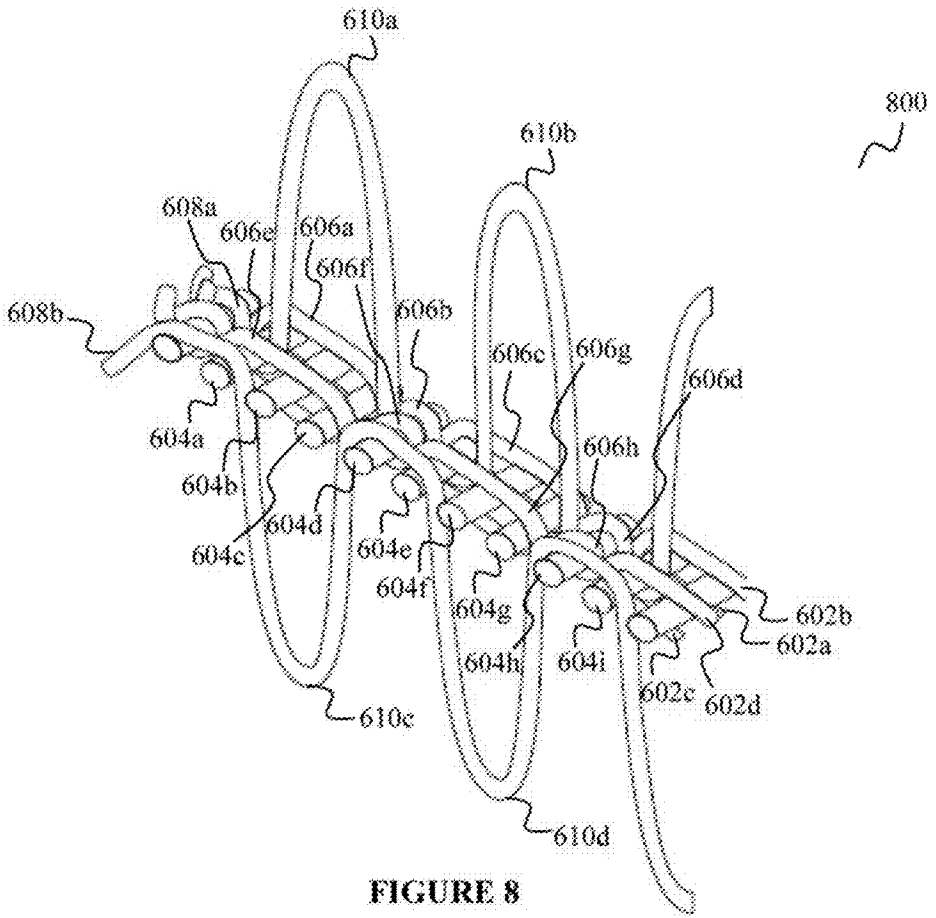

FIGS. 6 and 7 respectively illustrate first and second interlacing arrangements that are incorporated within a second embodiment of a terry weave sequence in accordance with the present invention. FIG. 6 illustrates a first interlacing arrangement, FIG. 7 illustrates a second interlacing arrangement. FIG. 8 illustrates an embodiment of the terry weave sequence incorporating both of said first interlacing arrangement and the second interlacing arrangement.

FIG. 6 illustrates a first interlacing arrangement 600A comprising a first ground warp yarn pair 602*a*, 602*b*, a first pile warp yarn 608*a*, and a plurality of ground weft yarns 604*a* to 604*i*. The first ground warp yarn pair comprises warp yarns 602*a* and 602*b* that are interlaced and positioned adjacent to first pile warp yarn 608*a*. The first ground warp yarn pair 602*a*, 602*b* is interlaced with ground weft yarns such that first weft yarn 604*a*, second weft yarn 604*b* and third weft yarn 604*c* are positioned within a first shed 606*a* formed by first ground warp yarn pair 602*a* and 602*b*. Additionally, a fourth weft yarn 604*d* is positioned within a second shed 606*b* formed by first ground warp yarn pair 602*a* and 602*b*. A fifth weft yarn 604*e*, sixth weft yarn 604*f* and seventh weft yarn 604*g* are positioned within a third shed 606*c* formed by first ground warp yarn pair 602*a* and 602*b*. Additionally, an eighth weft yarn 604*h* is positioned within a fourth shed 606*d* formed by first ground warp yarn pair 602*a* and 602*b*. Eighth weft yarn 604*h* is followed by immediately adjacent weft yarn 604*i*.

First pile warp yarn 608*a* is interlaced within first interlacing arrangement 600A so as to form a first pile loop 610*a* and a second pile loop 610*b*. First pile loop 610*a* is formed over first weft yarn 604*a*, second weft yarn 604*b*, third weft yarn 604*c* and fourth weft yarn 604*d*. More specifically first pile loop 610*a* is formed by passing first pile warp yarn 608*a* (i) between first weft yarn 604*a* and second weft yarn 604*b*, (ii) over second weft yarn 604*b* and third weft yarn 604*c* in a loop (formed on a top surface/face surface of the ground substrate), (iii) between third weft yarn 604*c* and fourth weft yarn 604*d*, and (iv) beneath fourth weft yarn 604*d* and fifth weft yarn 604*e*. Likewise, second pile loop 610*b* is formed over fifth weft yarn 604*e*, sixth weft yarn 604*f*, seventh weft yarn 604*g* and eighth weft yarn 604*h*. Specifically, second pile loop 610*b* is formed by passing first pile warp yarn 608*a* (i) between fifth weft yarn 604*e* and sixth weft yarn 604*f*, (ii) over sixth weft yarn 604*f* and seventh weft yarn 604*g* in a loop (formed on a top surface/face surface of the ground substrate), (iii) between seventh weft yarn 604*g* and eighth weft yarn 604*h*, and (iv) thereafter beneath eighth weft yarn 604*h* and ninth weft yarn 604*i*.

FIG. 7 illustrates a second interlacing arrangement 600B comprising a second ground warp yarn pair 602*c*, 602*d*, and a second pile warp yarn 608*b*, respectively interlaced through ground weft yarns 604*a* to 604*i*. The second ground warp yarn pair comprises warp yarns 602*c* and 602*d* that are interlaced and positioned adjacent to second pile warp yarn 608*b*. The second ground warp yarn pair 602*c*, 602*d* is interlaced with ground weft yarns such that first weft yarn 604*a*, second weft yarn 604*b* and third weft yarn 604*c* are positioned within a fifth shed 606*e* formed by second ground warp yarn pair 602*c* and 602*d*. Fourth weft yarn 604*d* is positioned within a sixth shed 606*f* formed by second ground warp yarn pair 602*c* and 602*d*. Fifth weft yarn 604*e*, sixth weft yarn 604*f* and seventh weft yarn 604*g* are positioned within a seventh shed 606*g* formed by second ground warp yarn pair 602*c* and 602*d*. Eighth weft yarn 604*h* is positioned within an eighth shed 606*h* formed by second ground warp yarn pair 602*c* and 602*d*.

Second pile warp yarn 608*b* is interlaced within second interlacing arrangement 600B so as to form a third pile loop 610*c* and a fourth pile loop 610*d*. Third pile loop 610*c* is formed over first weft yarn 604*a*, second weft yarn 604*b*, third weft yarn 604*c* and fourth weft yarn 604*d*. More specifically, third pile loop 610*c* is formed by passing second pile warp yarn 608*b* (i) between first weft yarn 604*a* and second weft yarn 604*b*, (ii) over second weft yarn 604*b* and third weft yarn 604*c* in a loop (formed on a bottom surface/back surface of the ground substrate), (iii) between third weft yarn 604*c* and fourth weft yarn 604*d* and (iv) and over fourth weft yarn 604*d* and fifth weft yarn 604*e*. Likewise, fourth pile loop 610*d* is formed over fifth weft yarn 604*e*, sixth weft yarn 604*f*, seventh weft yarn 604*g* and eighth weft yarn 604*h*. Specifically, fourth pile loop 610*d* is formed by passing second pile warp yarn 608*b* (i) between fifth weft yarn 604*e* and sixth weft yarn 604*f*, (ii) over sixth weft yarn 604*f* and seventh weft yarn 604*g* in a loop (formed on a bottom surface/back surface of the ground substrate), (iii) between seventh weft yarn 604*g* and eighth weft yarn 604*h* and (iv) over eighth weft yarn 604*h* and a ninth weft yarn 604*i*.

FIG. 8 illustrates a terry weave sequence 800 in accordance with the present invention, wherein, first interlacing arrangement 600A (as illustrated in FIG. 6) and second interlacing arrangement 600B (as illustrated in FIG. 7) are incorporated within terry weave sequence 800.

As illustrated in FIG. 8, first pile loop 610*a* is formed on a face surface of the ground substrate (i.e. the ground fabric comprising interwoven warp and weft yarns). Simultaneously the opposite surface (i.e. the back surface) of the ground substrate comprises a first region having boundaries defined by (a) first ground warp yarn pair 602*a*, 602*b*, (b) second ground warp yarn pair 602*c*, 602*d*, (c) first weft yarn 604*a* and (d) fourth weft yarn 604*d*—which first region is devoid or free of pile loop formation (i.e. no pile loop is formed over this region on said back surface of the ground substrate).

Likewise, second pile loop 610*b* is formed on a face surface of the ground substrate. Simultaneously an opposite surface (i.e. the back surface) of the ground substrate comprises a second region having boundaries defined by (a) first ground warp yarn pair 602*a*, 602*b*, (b) second ground warp yarn pair 602*c*, 602*d*, (c) fifth weft yarn 604*e* and (d) eighth weft yarn 604*h*—which second region is devoid or free of pile loop formation (i.e. no pile loop is provided in this region on said back surface of the ground substrate).

Additionally, as illustrated in FIG. 8, third pile loop 610*c* is formed on a back surface of the ground substrate. Simultaneously an opposite surface of the ground substrate (i.e. the face surface) comprises a third region having boundaries defined by (a) second ground warp yarn pair 602*c*, 602*d*, (b) a third ground warp yarn pair (not shown in FIG. 8) that is adjacent to second ground warp yarn pair 602*c*, 602*d*, and which is positioned such that second ground warp yarn pair 602*c*, 602*d* is interposed between said third ground warp yarn pair and first ground warp yarn pair 602*a*, 602*b*, (c) first weft yarn 604*a* and (d) fourth weft yarn 604*d*—which third region is devoid or free of pile loop formation (i.e. no pile loop is formed over this region on the face surface of the ground substrate).

Likewise, fourth pile loop 610*d* is formed on a back surface of the ground substrate. Simultaneously an opposite surface (i.e. the face surface) of the ground substrate comprises a fourth region having boundaries defined by (a) second ground warp yarn pair 602*c*, 602*d*, (b) the third ground warp yarn pair, (c) fifth weft yarn 604*e* and (d) eighth weft yarn 604*h*—which fourth region is devoid or free of pile loop formation (i.e. no pile loop is formed over this region on the face surface of the ground substrate).

Additionally, as is apparent from weave sequence 800 as illustrated in FIG. 8, first pile loop 610*a* and third pile loop 610*c* are respectively formed on opposite surfaces of the ground substrate, while second pile loop 610*b* and fourth pile loop 610*d* are respectively formed on opposite surfaces of the ground substrate.

The terry weave sequence 800 illustrated in FIG. 8 shows first ground warp yarn pair 602*a*, 602*b* positioned adjacent to second ground warp yarn pair 602*c*, 602*d* with only first pile yarn 608*a* interposed therebetween. For the purposes of the present invention however, one or more additional ground warp yarn pairs may be interposed between first ground warp yarn pair 602*a*, 602*b* and second ground warp yarn pair 602*c*, 602*d*. In an embodiment of the invention, while one or more additional ground warp yarn pairs may be interposed between first ground warp yarn pair 602*a*, 602*b* and second ground warp yarn pair 602*c*, 602*d*, no other pile yarn (i.e. no pile yarn other than first pile yarn 608*a*) is interposed between first ground warp yarn pair 602*a*, 602*b* and second ground warp yarn pair 602*c*, 602*d*.

The invention embodiments described above relate to terry fabrics having a repeating ground weave sequence comprising 3 ground weft yarns positioned within a first shed formed by a ground warp yarn pair, followed by one ground weft yarn positioned within a second shed formed by the ground warp yarn pair, wherein the first shed and second shed may be adjacent to each other. It would be understood that one or both of the first shed and the second shed may have a larger number of ground weft yarns positioned therein. FIGS. 9 to 14 illustrate exemplary embodiments of such type.

Figure 10:
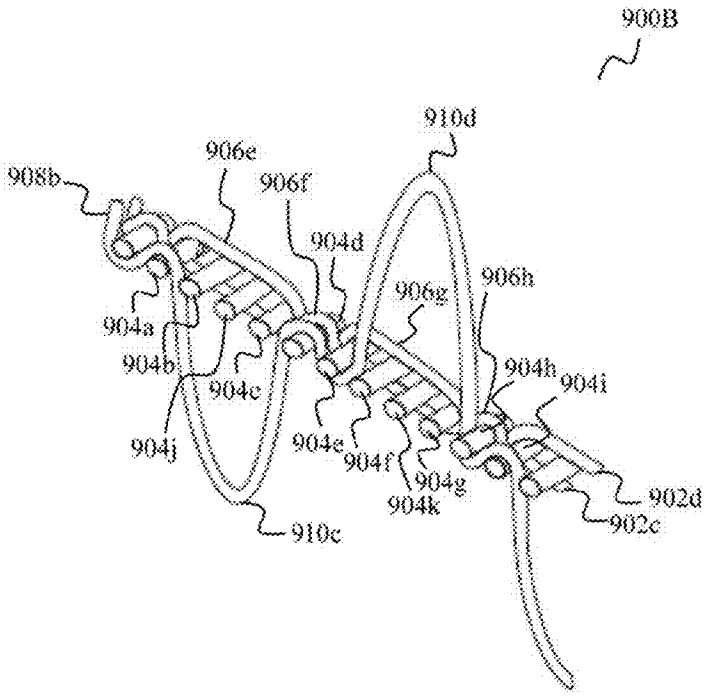
FIGS. 9, 10 and 11 illustrate perspective and transverse views of a terry weave having a 5 pick repeating sequence in accordance with the present invention.
Figure 9:
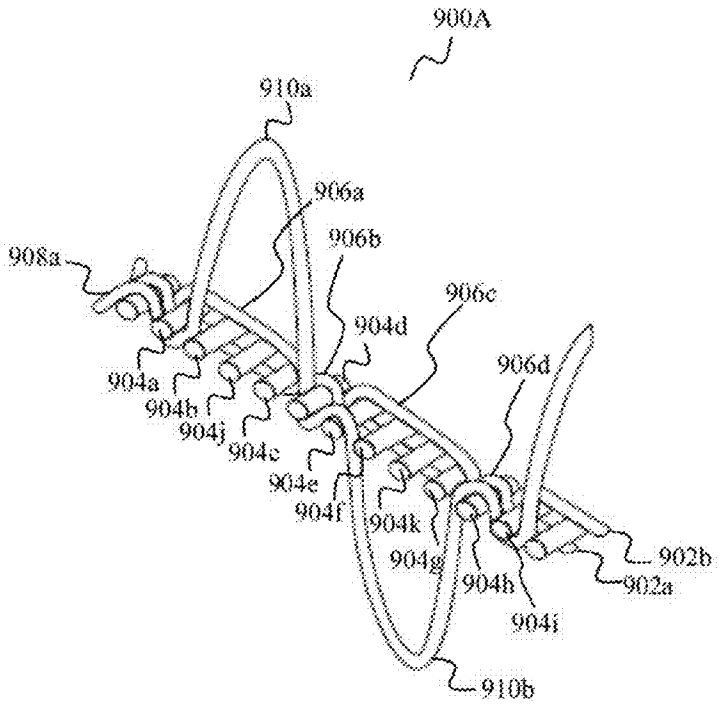
Figure 11:
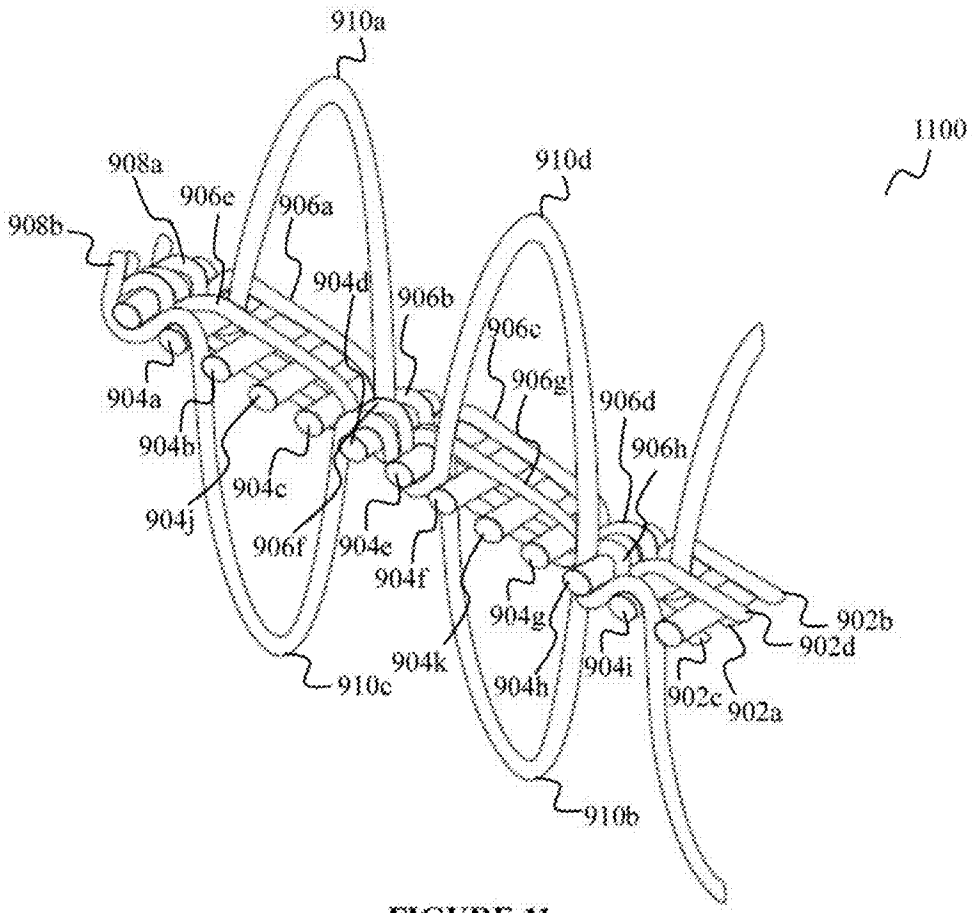

FIGS. 9 and 10 respectively illustrate first and second interlacing arrangements that are incorporated within an alternate terry weave sequence, in accordance with the present invention. FIG. 9 illustrates a first interlacing arrangement, FIG. 10 illustrates a second interlacing arrangement. FIG. 11 illustrates the terry weave sequence incorporating both the first interlacing arrangement and the second interlacing arrangement.

FIG. 9 illustrates a first interlacing arrangement 900A comprising a first ground warp yarn pair 902*a*, 902*b*, a first pile warp yarn 908*a*, and a plurality of ground weft yarns 904*a* to 904*k*. The first ground warp yarn pair comprises warp yarns 902*a* and 902*b* that are interlaced and positioned adjacent to first pile warp yarn 908*a*. The first ground warp yarn pair 902*a*, 902*b* is interlaced with ground weft yarns such that first weft yarn 904*a*, second weft yarn 904*b* and third weft yarn 904*c* are positioned within a first shed 906*a* formed by first ground warp yarn pair 902*a* and 902*b*. Additionally, a fourth weft yarn 904*d* is positioned within a second shed 906*b* formed by first ground warp yarn pair 902*a* and 902*b*. A fifth weft yarn 904*e*, sixth weft yarn 904*f* and seventh weft yarn 904*g* are positioned within a third shed 906*c* formed by first ground warp yarn pair 902*a* and 902*b*. Additionally, an eighth weft yarn 904*h* is positioned within a fourth shed 906*d* formed by first ground warp yarn pair 902*a* and 902*b*. Eighth weft yarn 904*h* is followed by immediately adjacent weft yarn 904*i*. Yet further, second weft yarn 904*b* and third weft yarn 904*c* have an additional weft yarn 904*j* interposed therebetween, which additional weft yarn 904*j* is positioned within first shed 906*a* formed by first ground warp yarn pair 902*a* and 902*b*. Sixth weft yarn 904*f* and seventh weft yarn 904*g* also have an additional weft yarn 904*k* interposed therebetween, which additional weft yarn 904*k* is positioned within third shed 906*c* formed by first ground warp yarn pair 902*a* and 902*b*.

First pile warp yarn 908*a* is interlaced within first interlacing arrangement 900A so as to form a first pile loop 910*a* and a second pile loop 910*b*. First pile loop 910*a* is formed over first weft yarn 904*a*, second weft yarn 904*b*, additional weft yarn 904*j*, third weft yarn 904*c* and fourth weft yarn 904*d*. More specifically first pile loop 910*a* is formed by passing first pile warp yarn 908*a* (i) between first weft yarn 904*a* and second weft yarn 904*b*, (ii) over second weft yarn 904*b*, additional weft yarn 904*j* and third weft yarn 904*c* in a loop (formed on a top surface/face surface of the ground substrate), (iii) between third weft yarn 904*c* and fourth weft yarn 904*d*, and (iv) between fourth weft yarn 904*d* and fifth weft yarn 904*e*. Likewise, second pile loop 910*b* is formed over fifth weft yarn 904*e*, sixth weft yarn 904*f*, additional weft yarn 904*k*, seventh weft yarn 904*g* and eighth weft yarn 904*h*. Specifically, second pile loop 910*b* is formed by passing first pile warp yarn 908*a* (i) between fifth weft yarn 904*e* and sixth weft yarn 904*f*, (ii) over sixth weft yarn 904*f*, additional weft yarn 904*k*, and seventh weft yarn 904*g* in a loop (formed on a bottom surface/back surface of the ground substrate), (iii) between seventh weft yarn 904*g* and eighth weft yarn 904*h*, and (iv) between eighth weft yarn 904*h* and ninth weft yarn 904*i*.

FIG. 10 illustrates a second interlacing arrangement 900B comprising a second ground warp yarn pair 902*c*, 902*d*, and a second pile warp yarn 908*b*, respectively interlaced through ground weft yarns 904*a* to 904*k*. The second ground warp yarn pair comprises warp yarns 902*c* and 902*d* that are interlaced and positioned adjacent to second pile warp yarn 908*b*. The second ground warp yarn pair 902*c*, 902*d* is interlaced with ground weft yarns such that first weft yarn 904*a*, second weft yarn 904*b* and third weft yarn 904*c* are positioned within a fifth shed 906*e* formed by second ground warp yarn pair 902*c* and 902*d*. Fourth weft yarn 904*d* is positioned within a sixth shed 906*f* formed by second ground warp yarn pair 902*c* and 902*d*. Fifth weft yarn 904*e*, sixth weft yarn 904*f* and seventh weft yarn 904*g* are positioned within a seventh shed 906*g* formed by second ground warp yarn pair 902*c* and 902*d*. Eighth weft yarn 904*h* is positioned within an eighth shed 906*h* formed by second ground warp yarn pair 902*c* and 902*d*. Additional weft yarn 904*j* (which is interposed between second weft yarn 904*b* and third weft yarn 904*c*) is positioned within fifth shed 906*e* formed by second ground warp yarn pair 902*c* and 902*d*. Additional weft yarn 904*k* (which is interposed between sixth weft yarn 904*f* and seventh weft yarn 904*g*) is positioned within seventh shed 906*g* formed by second ground warp yarn pair 902*c* and 902*d*.

Second pile warp yarn 908*b* is interlaced within second interlacing arrangement 900B so as to form a third pile loop 910*c* and a fourth pile loop 910*d*. Third pile loop 910*c* is formed over first weft yarn 904*a*, second weft yarn 904*b*, additional weft yarn 904*j*, third weft yarn 904*c* and fourth weft yarn 904*d*. More specifically, third pile loop 910*c* is formed by passing second pile warp yarn 908*b* (i) between first weft yarn 904*a* and second weft yarn 904*b*, (ii) over second weft yarn 904*b*, additional weft yarn 904*j*, and third weft yarn 904*c* in a loop (formed on a bottom surface/back surface of the ground substrate), (iii) between third weft yarn 904*c* and fourth weft yarn 904*d* and (iv) between fourth weft yarn 904*d* and fifth weft yarn 904*e*. Likewise, fourth pile loop 910*d* is formed over fifth weft yarn 904*e*, sixth weft yarn 904*f*, additional weft yarn 904*k*, seventh weft yarn 904*g* and eighth weft yarn 904*h*. Specifically, fourth pile loop 910*d* is formed by passing second pile warp yarn 908*b* (i) between fifth weft yarn 904*e* and sixth weft yarn 904*f*, (ii) over sixth weft yarn 904*f*, additional weft yarn 904*k* and seventh weft yarn 904*g* in a loop (formed on a top surface/face surface of the ground substrate), (iii) between seventh weft yarn 904*g* and eighth weft yarn 904*h* and (iv) between eighth weft yarn 904*h* and a ninth weft yarn 904*i*.

FIG. 11 illustrates a terry weave sequence 1100 in accordance with the present invention, wherein, first interlacing arrangement 900A (as illustrated in FIG. 9) and second interlacing arrangement 900B (as illustrated in FIG. 10) are incorporated within terry weave sequence 1100.

As illustrated in FIG. 11, first pile loop 910*a* is formed on a face surface of the ground substrate. Simultaneously the opposite surface (i.e. the back surface) of the ground substrate comprises a first region having boundaries defined by (a) first ground warp yarn pair 902*a*, 902*b*, (b) second ground warp yarn pair 902*c*, 902*d*, (c) first weft yarn 904*a* and (d) fourth weft yarn 904*d*—which first region is devoid or free of pile loop formation (i.e. no pile loop is formed over this region on said back surface of the ground substrate).

Likewise, second pile loop 910*b* is formed on a back surface of the ground substrate. Simultaneously an opposite surface (i.e. the face surface) of the ground substrate comprises a second region having boundaries defined by (a) first ground warp yarn pair 902*a*, 902*b*, (b) second ground warp yarn pair 902*c*, 902*d*, (c) fifth weft yarn 904*e* and (d) eighth weft yarn 904*h*—which second region is devoid or free of pile loop formation (i.e. no pile loop is provided in this region on said face surface of the ground substrate).

Additionally, as illustrated in FIG. 11, third pile loop 910*c* is formed on a back surface of the ground substrate. Simultaneously an opposite surface of the ground substrate (i.e. the face surface) comprises a third region having boundaries defined by (a) second ground warp yarn pair 902*c*, 902*d*, (b) a third ground warp yarn pair (not shown in FIG. 11) that is adjacent to second ground warp yarn pair 902*c*, 902*d*, and which is positioned such that second ground warp yarn pair 902*c*, 902*d* is interposed between said third ground warp yarn pair and first ground warp yarn pair 902*a*, 902*b*, (c) first weft yarn 904*a* and (d) fourth weft yarn 904*d*—which third region is devoid or free of pile loop formation (i.e. no pile loop is formed over this region on the face surface of the ground substrate).

Likewise, fourth pile loop 910*d* is formed on a face surface of the ground substrate. Simultaneously an opposite surface (i.e. the back surface) of the ground substrate comprises a fourth region having boundaries defined by (a) second ground warp yarn pair 902*c*, 902*d*, (b) the third ground warp yarn pair, (c) fifth weft yarn 904*e* and (d) eighth weft yarn 904*h*—which fourth region is devoid or free of pile loop formation (i.e. no pile loop is formed over this region on back surface of the ground substrate).

As is apparent from weave sequence 1100 as illustrated in FIG. 11, first pile loop 910*a* and third pile loop 910*c* are respectively formed on opposite surfaces of the ground substrate, while second pile loop 910*b* and fourth pile loop 910*d* are respectively formed on opposite surfaces of the ground substrate.

The terry weave sequence 1100 illustrated in FIG. 11 shows first ground warp yarn pair 902*a*, 902*b* positioned adjacent to second ground warp yarn pair 902*c*, 902*d* with only first pile yarn 908*a* interposed therebetween. For the purposes of the embodiment under discussion however, one or more additional ground warp yarn pairs may be interposed between first ground warp yarn pair 902*a*, 902*b* and second ground warp yarn pair 902*c*, 902*d*—provided however in a specific embodiment, no other pile yarn (i.e. no pile yarn other than first pile yarn 908*a*) is interposed between first ground warp yarn pair 902*a*, 902*b* and second ground warp yarn pair 902*c*, 902*d*.

The illustrations in FIGS. 9 to 11 illustrate embodiments of the terry weave sequence where first pile yarn 908*a* forms pile loops alternately on face and back surfaces of the ground substrate, while second pile yarn 908*b* also forms pile loops alternately on face and back surfaces of the ground substrate. In another embodiment of the invention, illustrated in FIGS. 12, 13 and 14, the first pile yarn may form pile loops on only one of the face or back surface of the ground substrate while the second pile yarn may form pile loops on only the other of the face or back surface of the ground substrate.

Figure 13:
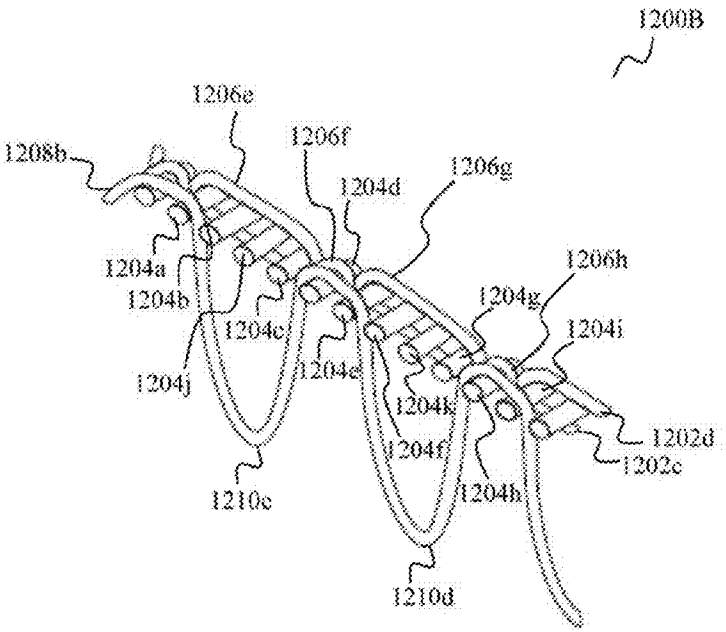
FIGS. 12, 13 and 14 illustrate perspective and transverse views of a terry weave having a 5 pick repeating sequence in accordance with the present invention.
Figure 12:
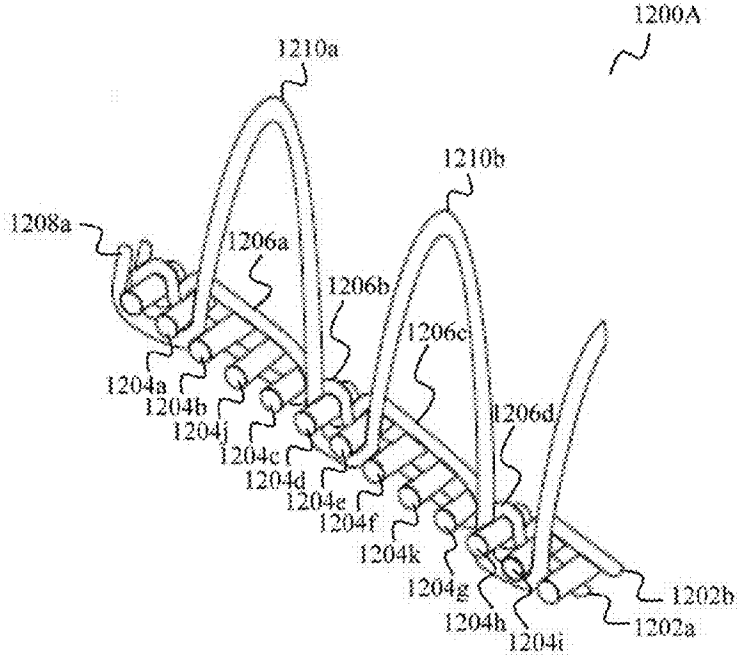
Figure 14:
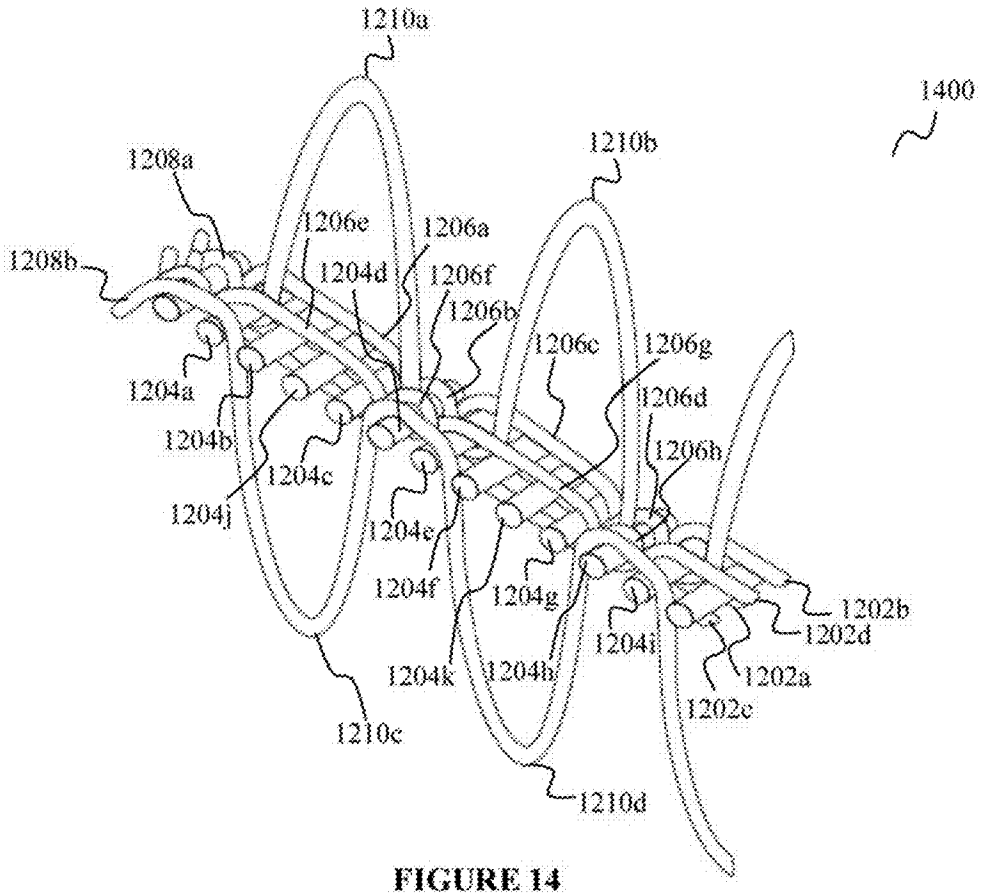

FIGS. 12 and 13 respectively illustrate first and second interlacing arrangements that are incorporated within a second embodiment of a terry weave sequence in accordance with the present invention. FIG. 12 illustrates a first interlacing arrangement, FIG. 13 illustrates a second interlacing arrangement. FIG. 14 illustrates an embodiment of the terry weave sequence incorporating both of said first interlacing arrangement and the second interlacing arrangement.

FIG. 12 illustrates a first interlacing arrangement 1200A comprising a first ground warp yarn pair 1202*a*, 1202*b*, a first pile warp yarn 1208*a*, and a plurality of ground weft yarns 1204*a* to 1204*k*. The first ground warp yarn pair comprises warp yarns 1202*a* and 1202*b* that are interlaced and positioned adjacent to first pile warp yarn 1208*a*. The first ground warp yarn pair 1202*a*, 1202*b* is interlaced with ground weft yarns such that first weft yarn 1204*a*, second weft yarn 1204*b* and third weft yarn 1204*c* are positioned within a first shed 1206*a* formed by first ground warp yarn pair 1202*a* and 1202*b*. Additionally, a fourth weft yarn 1204*d* is positioned within a second shed 1206*b* formed by first ground warp yarn pair 1202*a* and 1202*b*. A fifth weft yarn 1204*e*, sixth weft yarn 1204*f* and seventh weft yarn 1204*g* are positioned within a third shed 1206*c* formed by first ground warp yarn pair 1202*a* and 1202*b*.

Additionally, an eighth weft yarn 1204*h* is positioned within a fourth shed 1206*d* formed by first ground warp yarn pair 1202*a* and 1202*b*. Eighth weft yarn 1204*h* is followed by immediately adjacent weft yarn 1204*i*. Yet further, second weft yarn 1204*b* and third weft yarn 1204*c* have an additional weft yarn 1204*j* interposed therebetween, which additional weft yarn 1204*j* is positioned within first shed 1206*a* formed by ground warp yarn pair 1202*a* and 1202*b*. Sixth weft yarn 1204*f* and seventh weft yarn 1204*g* also have an additional weft yarn 1204*k* interposed therebetween, which additional weft yarn 1204*k* is positioned within third shed 1206*c* formed by ground warp yarn pair 1202*a* and 1202*b*.

First pile warp yarn 1208*a* is interlaced within first interlacing arrangement 1200A so as to form a first pile loop 1210*a* and a second pile loop 1210*b*. First pile loop 1210*a* is formed over first weft yarn 1204*a*, second weft yarn 1204*b*, additional weft yarn 1204*j*, third weft yarn 1204*c* and fourth weft yarn 1204*d*. More specifically, first pile loop

1210*a* is formed by passing first pile warp yarn 1208*a* (i) between first weft yarn 1204*a* and second weft yarn 1204*b*, (ii) over second weft yarn 1204*b*, additional weft yarn 1204*j*, and third weft yarn 1204*c* in a loop (formed on a top surface/face surface of the ground substrate), (iii) between third weft yarn 1204*c* and fourth weft yarn 1204*d*, and (iv) beneath fourth weft yarn 1204*d* and fifth weft yarn 1204*e*. Likewise, second pile loop 1210*b* is formed over fifth weft yarn 1204*e*, sixth weft yarn 1204*f*, additional weft yarn 1204*k*, seventh weft yarn 1204*g*, and eighth weft yarn 1204*h*. Specifically, second pile loop 1210*b* is formed by passing first pile warp yarn 1208*a* (i) between fifth weft yarn 1204*e* and sixth weft yarn 1204*f*, (ii) over sixth weft yarn 604*f*, additional weft yarn 1204K, and seventh weft yarn 1204*g* in a loop (formed on a top surface/face surface of the ground substrate), (iii) between seventh weft yarn 1204*g* and eighth weft yarn 1204*h*, and (iv) thereafter beneath eighth weft yarn 1204*h* and ninth weft yarn 1204*i*.

FIG. 13 illustrates a second interlacing arrangement 1200B comprising a second ground warp yarn pair 1202*c*, 1202*d*, and a second pile warp yarn 1208*b*, respectively interlaced through ground weft yarns 1204*a* to 1204*k*. The second ground warp yarn pair comprises warp yarns 1202*c* and 1202*d* that are interlaced and positioned adjacent to second pile warp yarn 1208*b*. The second ground warp yarn pair 1202*c*, 1202*d* is interlaced with ground weft yarns such that first weft yarn 1204*a*, second weft yarn 1204*b* and third weft yarn 1204*c* are positioned within a fifth shed 1206*e* formed by second ground warp yarn pair 1202*c* and 1202*d*. Fourth weft yarn 1204*d* is positioned within a sixth shed 1206*f* formed by second ground warp yarn pair 1202*c* and 1202*d*. Fifth weft yarn 1204*e*, sixth weft yarn 1204*f* and seventh weft yarn 1204*g* are positioned within a seventh shed 1206*g* formed by second ground warp yarn pair 1202*c* and 1202*d*. Eighth weft yarn 1204*h* is positioned within an eighth shed 1206*h* formed by second ground warp yarn pair 1202*c* and 1202*d*. Additional weft yarn 1204*j* (which is interposed between second weft yarn 1204*b* and third weft yarn 1204*c*) is positioned within fifth shed 1206*e* formed by second ground warp yarn pair 1202*c* and 1202*d*. Additional weft yarn 1204*k* (which is interposed between sixth weft yarn 1204*f* and seventh weft yarn 1204*g*) is positioned within seventh shed 1206*g* formed by second ground warp yarn pair 1202*c* and 1202*d*.

Second pile warp yarn 1208*b* is interlaced within second interlacing arrangement 1200B so as to form a third pile loop 1210*c* and a fourth pile loop 1210*d*. Third pile loop 1210*c* is formed over first weft yarn 1204*a*, second weft yarn 1204*b*, additional weft yarn 1204*j*, third weft yarn 1204*c* and fourth weft yarn 1204*d*. More specifically, third pile loop 1210*c* is formed by passing second pile warp yarn 1208*b* (i) between first weft yarn 1204*a* and second weft yarn 1204*b*, (ii) over second weft yarn 1204*b*, additional weft yarn 1204*j*, and third weft yarn 1204*c* in a loop (formed on a bottom surface/back surface of the ground substrate), (iii) between third weft yarn 1204*c* and fourth weft yarn 1204*d* and (iv) and over fourth weft yarn 1204*d* and fifth weft yarn 1204*e*. Likewise, fourth pile loop 1210*d* is formed over fifth weft yarn 1204*e*, sixth weft yarn 1204*f*, additional weft yarn 1204*k*, seventh weft yarn 1204*g* and eighth weft yarn 1204*h*.

Specifically, fourth pile loop 1210*d* is formed by passing second pile warp yarn 1208*b* (i) between fifth weft yarn 1204*e* and sixth weft yarn 1204*f*, (ii) over sixth weft yarn 1204*f*, additional weft yarn 1204*k*, and seventh weft yarn 1204*g* in a loop (formed on a bottom surface/back surface of the ground substrate), (iii) between seventh weft yarn 1204*g* and eighth weft yarn 1204*h* and (iv) over eighth weft yarn 1204*h* and a ninth weft yarn 1204*i*.

FIG. 14 illustrates a terry weave sequence 1400 in accordance with the present invention, wherein, first interlacing arrangement 1200A (as illustrated in FIG. 12) and second interlacing arrangement 1200B (as illustrated in FIG. 13) are incorporated within terry weave sequence 1400.

As illustrated in FIG. 14, first pile loop 1210*a* is formed on a face surface of the ground substrate (i.e. the ground fabric comprising interwoven warp and weft yarns). Simultaneously the opposite surface (i.e. the back surface) of the ground substrate comprises a first region having boundaries defined by (a) first ground warp yarn pair 1202*a*, 1202*b*, (b) second ground warp yarn pair 1202*c*, 1202*d*, (c) first weft yarn 1204*a* and (d) fourth weft yarn 1204*d*—which first region is devoid or free of pile loop formation (i.e. no pile loop is formed over this region on said back surface of the ground substrate).

Likewise, second pile loop 1210*b* is formed on a face surface of the ground substrate. Simultaneously an opposite surface (i.e. the back surface) of the ground substrate comprises a second region having boundaries defined by (a) first ground warp yarn pair 1202*c*, 1202*d*, (b) second ground warp yarn pair 1202*c*, 1202*d*, (c) fifth weft yarn 1204*e* and (d) eighth weft yarn 1204*h*—which second region is devoid or free of pile loop formation (i.e. no pile loop is provided in this region on said back surface of the ground substrate).

Additionally, as illustrated in FIG. 14, third pile loop 1210*c* is formed on a back surface of the ground substrate. Simultaneously an opposite surface of the ground substrate (i.e. the face surface) comprises a third region having boundaries defined by (a) second ground warp yarn pair 1202*c*, 1202*d*, (b) a third ground warp yarn pair (not shown in FIG. 14) that is adjacent to second ground warp yarn pair 1202*c*, 1202*d*, and which is positioned such that second ground warp yarn pair 1202*c*, 1202*d* is interposed between said third ground warp yarn pair and first ground warp yarn pair 1202*a*, 1202*b*, (c) first weft yarn 1204*a* and (d) fourth weft yarn 1204*d*—which third region is devoid or free of pile loop formation (i.e. no pile loop is formed over this region on the face surface of the ground substrate).

Likewise, fourth pile loop 1210*d* is formed on a back surface of the ground substrate. Simultaneously an opposite surface (i.e. the face surface) of the ground substrate comprises a fourth region having boundaries defined by (a) second ground warp yarn pair 1202*a*, 1202*b*, (b) the third ground warp yarn pair, (c) fifth weft yarn 1204*e* and (d) eighth weft yarn 1204*h*—which fourth region is devoid or free of pile loop formation (i.e. no pile loop is formed over this region on the face surface of the ground substrate).

Additionally, as is apparent from weave sequence 1400 as illustrated in FIG. 14, first pile loop 1210*a* and third pile loop 1210*c* are respectively formed on opposite surfaces of the ground substrate, while second pile loop 1210*b* and fourth pile loop 1210*d* are respectively formed on opposite surfaces of the ground substrate.

The terry weave sequence 1400 illustrated in FIG. 14 shows first ground warp yarn pair 1202*a*, 1202*b* positioned adjacent to second ground warp yarn pair 1202*c*, 1202*d* with only first pile yarn 1208*a* interposed therebetween. For the purposes of the present invention however, one or more additional ground warp yarn pairs may be interposed between first ground warp yarn pair 1202*a*, 1202*b* and second ground warp yarn pair 1202*c*, 1202*d*. In an embodiment of the invention, while one or more additional ground warp yarn pairs may be interposed between first ground warp yarn pair 1202*a*, 1202*b* and second ground warp yarn pair 1202*c*, 1202*d*, no other pile yarn (i.e. no pile yarn other than first pile yarn 1208*a*) is interposed between first ground warp yarn pair 1202*a*, 1202*b* and second ground warp yarn pair 1202*c*, 1202*d*.

The present invention additionally provides terry weaves fabrics which comprise one or more instances of the terry weave sequences described above in connection with FIGS. 3 to 14. An embodiment of the invention comprises a terry weave fabric having at least two and preferably more than two instances of the repeating terry weave sequences as described above.

In an embodiment of the terry fabric of the present invention, the terry weave sequence ensures positioning the second shed adjacent to the first shed, positioning the third shed adjacent to the second shed, positioning the fourth shed adjacent to the third shed, positioning the sixth shed adjacent to the fifth shed, positioning the seventh shed adjacent to the sixth shed and/or positioning the eighth shed adjacent to the seventh shed.

The repeated weave sequence may alternately ensure that at least one additional weft yarn is positioned between any of the second shed and the first shed, the third shed and the second shed, the fourth shed and the third shed, the sixth shed and the fifth shed, the seventh shed and the sixth shed and/or the eighth shed and the seventh shed.

In an embodiment of the invention, any of the first shed, third shed, fifth shed or seventh shed may have more than three weft yarns positioned therewithin. Likewise, any one of the second shed, fourth shed, sixth shed or eighth shed may have more than one weft yarn positioned therewithin.

It would be understood that the first ground warp yarn pair and the second ground warp yarn pair may be adjacent yarn pairs, having only a single pile yarn interposed therebetween. The first ground warp yarn pair and the second ground warp yarn pair may alternately have at least one additional ground warp yarn pair interposed therebetween. In an embodiment, the first pile warp yarn and the second pile warp yarn may be adjacent pile warp yarns.

In weaving a terry fabric, a plurality of instances of the terry weave sequences described above may be implemented within the terry fabric. In an embodiment, a first instance of the terry weave sequence may be located immediately adjacent to a second instance of the terry weave sequence. In another embodiment, the first pile yarn or the second pile yarn may be interlaced into the ground substrate in a repeating sequence that forms each pile loop over 4 or more weft yarns.

The invention additionally provides methods of weaving a terry fabric, the method comprising repeating at least one of the terry weave sequences described above in a plurality of instances while weaving a terry fabric.

A particular method embodiment of the present invention comprises a method of manufacturing a terry fabric comprising a plurality of longitudinally oriented ground warp yarns pairs, a plurality of longitudinally oriented pile warp yarns, and a plurality of weft yarns oriented substantially perpendicular to the ground warp yarn pairs. The method comprises weaving a terry fabric using a plurality of instances of a repeated weave sequence.

Weaving each repeated weave sequence includes weaving a first interlacing arrangement comprising a first ground warp yarn pair and a first pile warp yarn interlaced adjacent to and in contact with at least one yarn within the first ground warp yarn pair, and comprising the steps of (i) placement of first, second and third weft yarns within a first shed formed by the first ground warp yarn pair, (ii) placement of a fourth weft yarn within a second shed formed by the first ground warp yarn pair, wherein the second and third weft yarns are positioned between the first and fourth weft yarns, (iii) placement of fifth, sixth and seventh weft yarns within a third shed formed by the first ground warp yarn pair, (iv) placement of an eighth weft yarn within a fourth shed formed by the first ground warp yarn pair, wherein the sixth and seventh weft yarns are positioned between the fifth and eighth weft yarns, (v) forming a first pile loop, wherein said first pile loop is formed with the first pile yarn, and wherein said first pile loop is formed over the first, second, third and fourth weft yarns, on one of a face surface or a back surface of a ground substrate, (vi) forming a first region on a surface of the ground substrate that is opposite to the surface on which the first pile loop is formed, said first region having boundaries defined by (a) the first ground warp yarn pair, (b) a second ground warp yarn pair adjacent to the first ground warp yarn pair, (c) the first weft yarn and (d) the fourth weft yarn, wherein said first region is free of pile loop formation, (vii) forming a second pile loop, wherein said second pile loop is formed by the first pile yarn, and wherein said second pile loop is formed over the fifth, sixth, seventh and eighth weft yarns, on one of the face surface or the back surface of the ground substrate, (viii) forming a second region on a surface of the ground substrate that is opposite to the surface on which the second pile loop is formed, said second region having boundaries defined by (a) the first ground warp yarn pair, (b) the second ground warp yarn pair, (c) the fifth weft yarn and (d) the eighth weft yarn, wherein said second region is free of pile loop formation.

Weaving each repeated weave sequence additionally includes weaving a second interlacing arrangement comprising the second ground warp yarn pair and a second pile warp yarn interlaced adjacent to and in contact with at least one yarn within the second ground warp yarn pair, and comprising the steps of (i) placement of the first, second and third weft yarns within a fifth shed formed by the second ground warp yarn pair, (ii) placement of the fourth weft yarn within a sixth shed formed by the second ground warp yarn pair, (iii) placement of the fifth, sixth and seventh weft yarns within a seventh shed formed by the second ground warp yarn pair, (iv) the eighth weft yarn positioned within an eighth shed formed by the second ground warp yarn pair, (v) forming a third pile loop, wherein said third pile loop is formed by the second pile yarn, and wherein said third pile loop is formed over the first, second, third and fourth weft yarns, on one of the face surface or the back surface of the ground substrate, (vi) forming a third region on a surface of the ground substrate that is opposite to the surface on which the third pile loop is formed, said third region having boundaries defined by (a) the second ground warp yarn pair, (b) a third ground warp yarn pair adjacent to the second ground warp yarn pair and positioned such that the second ground warp yarn pair is interposed between the third ground warp yarn pair and the first ground warp yarn pair, (c) the first weft yarn and (d) the fourth weft yarn, wherein said third region is free of pile loop formation, (vii) forming a fourth pile loop, wherein said fourth pile loop formed by the second pile yarn, and wherein said fourth pile loop is formed over the fifth, sixth, seventh and eighth weft yarns on one of the face surface or the back surface of the ground substrate, (viii) forming a fourth region on a surface of the ground substrate that is opposite to the surface on which the fourth pile loop is formed, said fourth region having boundaries defined by (a) the second ground warp yarn pair, (b) the third ground warp yarn pair, (c) the fifth weft yarn and (d) the eighth weft yarn, wherein said fourth region is free of pile loop formation.

Weaving each repeated weave sequence includes ensuring that (i) one of the first pile loop and the third pile loop is formed on the face surface of the ground substrate, and the other of the first pile loop and the third pile loop is formed on the back surface of the ground substrate, and (ii) one of the second pile loop and the fourth pile loop is formed on the face surface of the ground substrate, and the other of the first pile loop and the third pile loop is formed on the back surface of the ground substrate.

In an embodiment of the invention, the method of manufacturing the terry fabric additionally comprises shearing one or more of the first pile loop, second pile loop, third pile loop and/or fourth pile loop, to generate cut tufted pile tuft on at least one surface of the ground substrate.

The terry weave sequences and terry weave fabrics in accordance with the above embodiments of the invention have been found to present several significant advantages.

Table A in FIG. 16 sets out results of comparative product testing using terry fabrics manufactured in accordance with embodiments of the present invention, in comparison with terry fabrics manufactured in accordance with terry weave sequences known in the prior art.

Terry fabric A corresponds to a fabric of the kind discussed in connection with FIGS. 3 to 8, whereas terry fabric E corresponds to a fabric of the kind discussed in connection with FIGS. 9 to 14. As will be observed, for a given grams per square meter (GSM) value, terry fabrics manufactured in accordance with the present invention exhibit significantly higher pick density, and cover factor (weft). Terry fabric A additionally exhibits absorbency that is comparable to prior art towels despite having a significantly lower loop density. Lower loop density has been found to significantly improve fabric softness of the resulting terry fabric. It would also be observed that terry fabrics A and E use significantly less pile yarn per inch, while offering absorbency that is comparable to prior art terry fabrics—which in presents significant cost and manufacturing efficiencies, particularly since pile yarn is typically more expensive that ground warp and weft yarns. In cases where pile yarn is manufactured using soluble fibers such as polyvinyl alcohol (PVA) fibers, lowering the pile per inch value also offers environmental advantages. Yet further, as is apparent from the data in Table A, terry fabrics manufactured in accordance with the present invention exhibit significantly improved tensile strength.

Figure 15A:
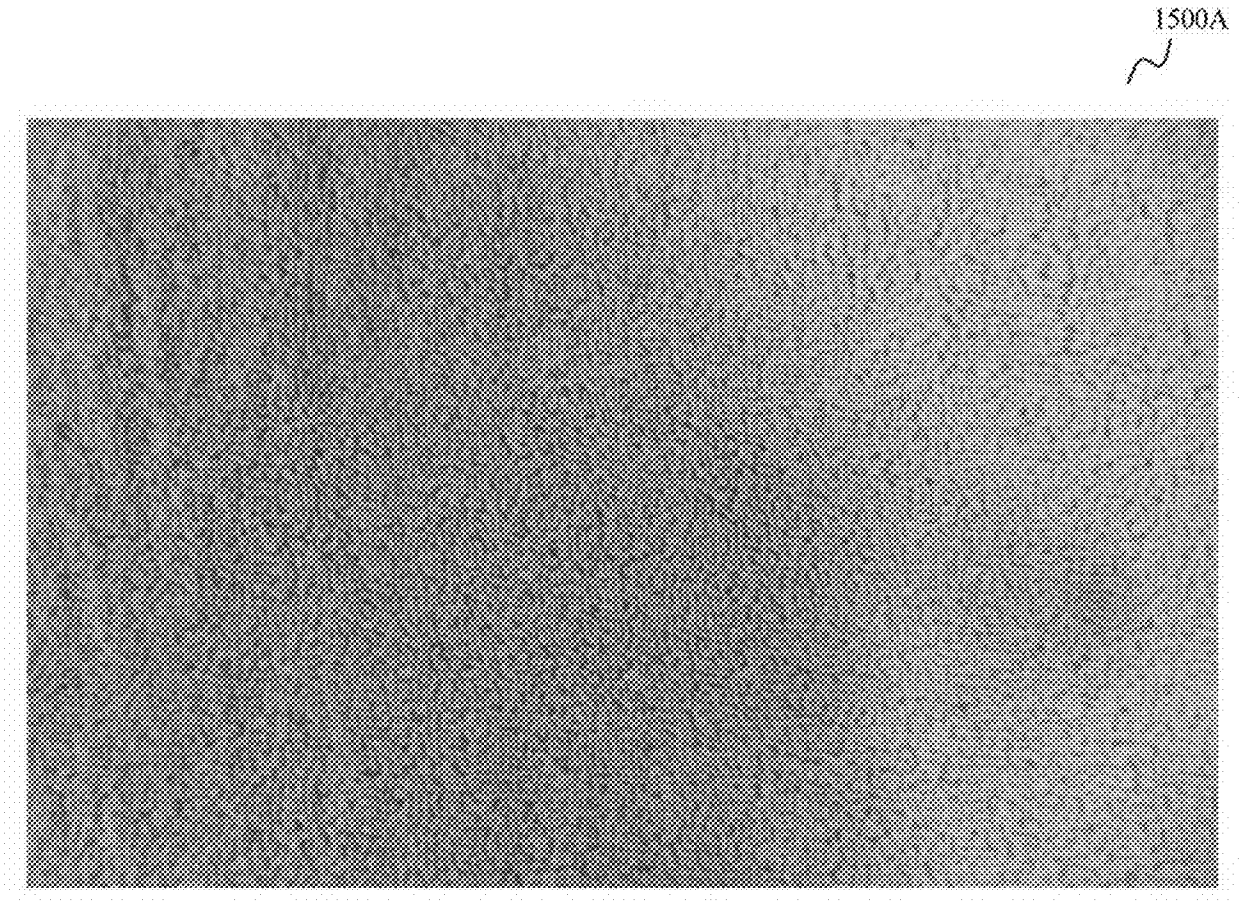
FIG. 15A is a photograph of a terry fabric manufactured in accordance with the terry weave sequence illustrated in FIGS. 1 and 2.
Figure 15B:
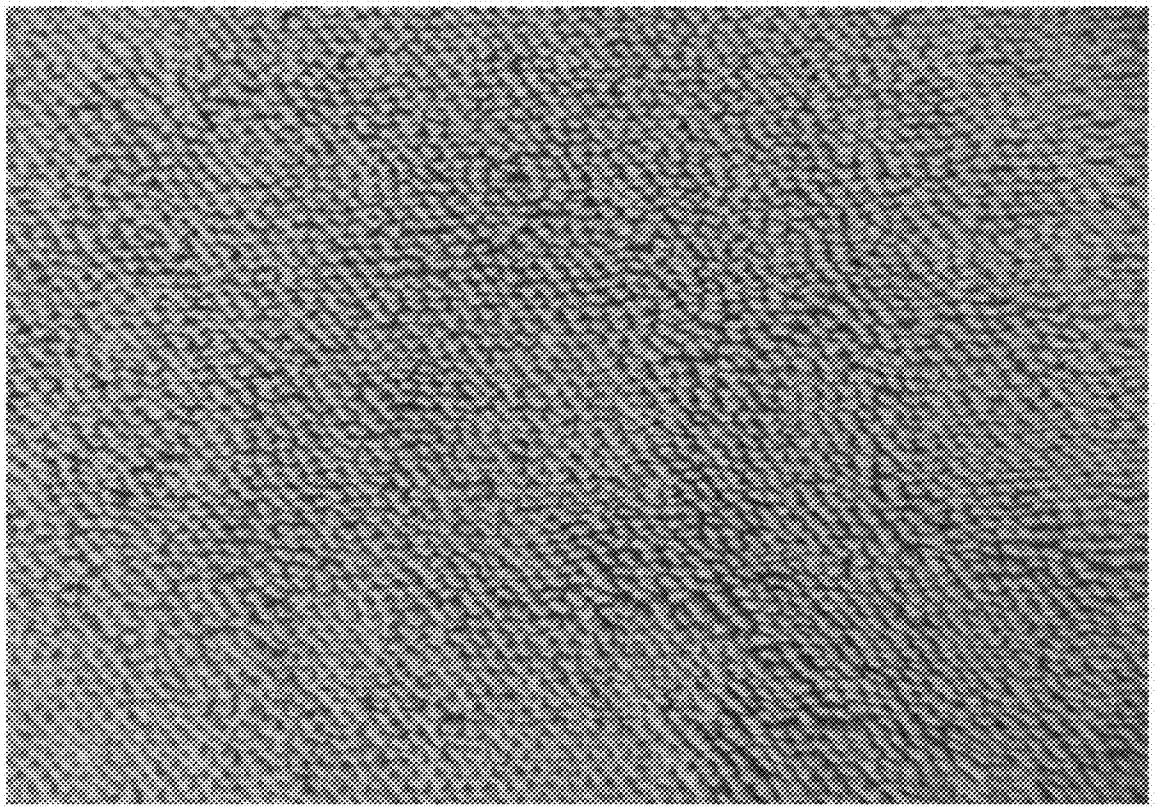
FIG. 15B is a photograph of a terry fabric manufactured in accordance with the terry weave sequence of FIGS. 3, 4 and 5.

In addition to the above, terry fabrics manufactured in accordance with teachings of the present invention have been found to have a distinctive and aesthetically appealing appearance and improved uniformity of texture in comparison with terry fabrics manufactured in accordance with terry weaves known in the prior art. FIG. 15B provides a photograph depicting appearance of a terry fabric manufactured in accordance with teachings of the present invention—which appearance is significantly different and aesthetically improved over the terry fabric photographs in FIG. 15A, which corresponds to a terry fabric manufactured in accordance with prior art methods.

The terry fabrics in accordance with the present invention may be manufactured using one or more non-soluble yarns and optionally one or more soluble yarns. Non-soluble yarns for manufacturing terry fabrics in accordance with teachings of the present invention may comprise any one or more natural fibers such as cotton, wool, silk, jute, flax, bamboo or ramie, or one or more regenerated/synthetic fibres such as lyocell, viscose, modal, soya, polyester, acrylic, rayon, charcoal, linen, corn, milk fibre, PLA (poly lactic acid) fibre etc. Soluble yarns for manufacturing ply yarns (or for that matter ground yarns) may include any of polyvinyl alcohol (PVA), wool or a yarn product that is sold under the trade name "solucell".

It would be understood that the examples and embodiment discussed anywhere in the present specification are illustrative only. Those skilled in the art would immediately appreciate that various modifications in form and detail may be made without departing from or offending the spirit and scope of the invention as defined by the appended claims.

We claim:

1. A terry fabric comprising a plurality of longitudinally oriented ground warp yarns pairs, a plurality of longitudinally oriented pile warp yarns, and a plurality of weft yarns oriented substantially perpendicular to the ground warp yarn pairs, the terry fabric comprising a repeated weave sequence, said repeated weave sequence comprising:

a first interlacing arrangement comprising a first ground warp yarn pair and a first pile warp yarn interlaced adjacent to and in contact with at least one yarn within the first ground warp yarn pair, the first interlacing arrangement comprising:

first, second and third weft yarns positioned within a first shed formed by the first ground warp yarn pair;

a fourth weft yarn positioned within a second shed formed by the first ground warp yarn pair, wherein the second and third weft yarns are positioned between the first and fourth weft yarns;

fifth, sixth and seventh weft yarns positioned within a third shed formed by the first ground warp yarn pair;

an eighth weft yarn positioned within a fourth shed formed by the first ground warp yarn pair, wherein the sixth and seventh weft yarns are positioned between the fifth and eighth weft yarns;

a first pile loop formed by the first pile yarn, wherein said first pile loop is formed over the first, second, third and fourth weft yarns on one of a face surface or a back surface of a ground substrate;

a first region on a surface of the ground substrate that is opposite to the surface on which the first pile loop is formed, said first region having boundaries defined by (i) the first ground warp yarn pair, (ii) a second ground warp yarn pair adjacent to the first ground warp yarn pair, (iii) the first weft yarn and (iv) the fourth weft yarn, wherein said first region is free of pile loop formation;

a second pile loop formed by the first pile yarn, wherein said second pile loop is formed over the fifth, sixth, seventh and eighth weft yarns on one of the face surface or the back surface of the ground substrate;

a second region on a surface of the ground substrate that is opposite to the surface on which the second pile loop is formed, said second region having boundaries defined by (i) the first ground warp yarn pair, (ii) the second ground warp yarn pair, (iii) the fifth weft yarn and (iv) the eighth weft yarn, wherein said second region is free of pile loop formation;

a second interlacing arrangement comprising the second ground warp yarn pair and a second pile warp yarn interlaced adjacent to and in contact with at least one yarn within the second ground warp yarn pair, the second interlacing arrangement comprising:

the first, second and third weft yarns positioned within a fifth shed formed by the second ground warp yarn pair;

the fourth weft yarn positioned within a sixth shed formed by the second ground warp yarn pair;

the fifth, sixth and seventh weft yarns positioned within a seventh shed formed by the second ground warp yarn pair;

the eighth weft yarn positioned within an eighth shed formed by the second ground warp yarn pair;

a third pile loop formed by the second pile yarn, wherein said third pile loop is formed over the first, second, third and fourth weft yarns on one of the face surface or the back surface of the ground substrate;

a third region on a surface of the ground substrate that is opposite to the surface on which the third pile loop is formed, said third region having boundaries defined by (i) the second ground warp yarn pair, (ii) a third ground warp yarn pair adjacent to the second ground warp yarn pair and positioned such that the second ground warp yarn pair is interposed between the third ground warp yarn pair and the first ground warp yarn pair, (iii) the first weft yarn and (iv) the fourth weft yarn, wherein said third region is free of pile loop formation;

a fourth pile loop formed by the second pile yarn, wherein said fourth pile loop is formed over the fifth, sixth, seventh and eighth weft yarns on one of the face surface or the back surface of the ground substrate;

a fourth region on a surface of the ground substrate that is opposite to the surface on which the fourth pile loop is formed, said fourth region having boundaries defined by (i) the second ground warp yarn pair, (ii) the third ground warp yarn pair, (iii) the fifth weft yarn and (iv) the eighth weft yarn, wherein said fourth region is free of pile loop formation;

wherein:

one of the first pile loop and the third pile loop is formed on the face surface of the ground substrate, and the other of the first pile loop and the third pile loop is formed on the back surface of the ground substrate; and one of the second pile loop and the fourth pile loop is formed on the face surface of the ground substrate, and the other of the second pile loop and the fourth pile loop is formed on the back surface of the ground substrate.

2. The terry fabric as claimed in claim 1, wherein the repeated weave sequence ensures one or more of:

positioning the second shed adjacent to the first shed;

positioning the third shed adjacent to the second shed;

positioning the fourth shed adjacent to the third shed;

positioning the sixth shed adjacent to the fifth shed;

positioning the seventh shed adjacent to the sixth shed; and positioning the eighth shed adjacent to the seventh shed.

3. The terry fabric as claimed in claim 1, wherein the repeated weave sequence ensures that at least one additional weft yarn is positioned between any of:

the second shed and the first shed;

the third shed and the second shed;

the fourth shed and the third shed;

the sixth shed and the fifth shed;

the seventh shed and the sixth shed; or the eighth shed and the seventh shed.

4. The terry fabric as claimed in claim 1, wherein any of the first shed, third shed, fifth shed or seventh shed includes more than three weft yarns positioned therewithin.

5. The terry fabric as claimed in claim 1, wherein any one of the second shed, fourth shed, sixth shed or eighth shed includes more than one weft yarn positioned therewithin.

6. The terry fabric as claimed in claim 1, wherein:

in the first interlacing arrangement, the first pile loop and the second pile loop are formed on opposite surfaces of the ground substrate; and in the second interlacing arrangement, the third pile loop and the fourth pile loop are formed on opposite surfaces of the ground substrate.

7. The terry fabric as claimed in claim 1, wherein:

in the first interlacing arrangement, the first pile loop and the second pile loop are formed on one of the face surface or the back surface of the ground substrate; and in the second interlacing arrangement, the third pile loop and the fourth pile loop are formed on the other of the face surface or the back surface of the ground substrate.

8. The terry fabric as claimed in claim 1, wherein the first ground warp yarn pair and the second ground warp yarn pair are adjacent yarn pairs, and having only a single pile yarn interposed therebetween.

9. The terry fabric as claimed in claim 1, wherein the first ground warp yarn pair and the second ground warp yarn pair have at least one additional ground warp yarn pair interposed therebetween.

10. The terry fabric as claimed in claim 1, wherein a plurality of instances of the repeated weave sequences are implemented within the terry fabric.

11. The terry fabric as claimed in claim 1, wherein a first instance of the repeated weave sequence is located immediately adjacent to a second instance of the repeated weave sequence.

12. The terry fabric as claimed in claim 1, where the first pile warp yarn and the second pile warp yarn are adjacent pile warp yarns.

13. The terry fabric as claimed in claim 1, wherein the first pile yarn or the second pile yarn is interlaced into the ground substrate in a repeating sequence that forms each pile loop over 4 or more weft yarns.

14. The terry fabric as claimed in claim 1, wherein the first pile yarn or the second pile yarn is interlaced into the ground substrate in a repeating sequence that forms each pile loop over 4 to 6 weft yarns.

15. A method of manufacturing a terry fabric comprising a plurality of longitudinally oriented ground warp yarns pairs, a plurality of longitudinally oriented pile warp yarns, and a plurality of weft yarns oriented substantially perpendicular to the ground warp yarn pairs, the method comprising weaving a terry fabric using a plurality of instances of a repeated weave sequence, wherein weaving each repeated weave sequence comprises:

weaving a first interlacing arrangement comprising a first ground warp yarn pair and a first pile warp yarn interlaced adjacent to and in contact with at least one yarn within the first ground warp yarn pair, comprising the steps of:

placement of first, second and third weft yarns within a first shed formed by the first ground warp yarn pair;

placement of a fourth weft yarn within a second shed formed by the first ground warp yarn pair, wherein the second and third weft yarns are positioned between the first and fourth weft yarns;

placement of fifth, sixth and seventh weft yarns within a third shed formed by the first ground warp yarn pair;

placement of an eighth weft yarn within a fourth shed formed by the first ground warp yarn pair, wherein the sixth and seventh weft yarns are positioned between the fifth and eighth weft yarns;

forming a first pile loop, wherein said first pile loop is formed with the first pile yarn, and wherein said first pile loop is formed over the first, second, third and fourth weft yarns, on one of a face surface or a back surface of a ground substrate;

forming a first region on a surface of the ground substrate that is opposite to the surface on which the first pile loop is formed, said first region having boundaries defined by (i) the first ground warp yarn pair, (ii) a second ground warp yarn pair adjacent to the first ground warp yarn pair, (iii) the first weft yarn and (iv) the fourth weft yarn, wherein said first region is free of pile loop formation;

forming a second pile loop, wherein said second pile loop is formed by the first pile yarn, and wherein said second pile loop is formed over the fifth, sixth, seventh and eighth weft yarns, on one of the face surface or the back surface of the ground substrate;

forming a second region on a surface of the ground substrate that is opposite to the surface on which the second pile loop is formed, said second region having boundaries defined by (i) the first ground warp yarn pair, (ii) the second ground warp yarn pair, (iii) the fifth weft yarn and (iv) the eighth weft yarn, wherein said second region is free of pile loop formation;

weaving a second interlacing arrangement comprising the second ground warp yarn pair and a second pile warp yarn interlaced adjacent to and in contact with at least one yarn within the second ground warp yarn pair, comprising the steps of:

placement of the first, second and third weft yarns within a fifth shed formed by the second ground warp yarn pair;

placement of the fourth weft yarn within a sixth shed formed by the second ground warp yarn pair;

placement of the fifth, sixth and seventh weft yarns within a seventh shed formed by the second ground warp yarn pair;

the eighth weft yarn positioned within an eighth shed formed by the second ground warp yarn pair;

forming a third pile loop, wherein said third pile loop is formed by the second pile yarn, and wherein said third pile loop is formed over the first, second, third and fourth weft yarns, on one of the face surface or the back surface of the ground substrate;

forming a third region on a surface of the ground substrate that is opposite to the surface on which the third pile loop is formed, said third region having boundaries defined by (i) the second ground warp yarn pair, (ii) a third ground warp yarn pair adjacent to the second ground warp yarn pair and positioned such that the second ground warp yarn pair is interposed between the third ground warp yarn pair and the first ground warp yarn pair, (iii) the first weft yarn and (iv) the fourth weft yarn, wherein said third region is free of pile loop formation;

forming a fourth pile loop, wherein said fourth pile loop formed by the second pile yarn, and wherein said fourth pile loop is formed over the fifth, sixth, seventh and eighth weft yarns on one of the face surface or the back surface of the ground substrate;

forming a fourth region on a surface of the ground substrate that is opposite to the surface on which the fourth pile loop is formed, said fourth region having boundaries defined by (i) the second ground warp yarn pair, (ii) thethird ground warp yarn pair, (iii) the fifth weft yarn and (iv) the eighth weft yarn, wherein said fourth region is free of pile loop formation;

wherein:

one of the first pile loop and the third pile loop is formed on the face surface of the ground substrate, and the other of the first pile loop and the third pile loop is formed on the back surface of the ground substrate; and one of the second pile loop and the fourth pile loop is formed on the face surface of the ground substrate, and the other of the second pile loop and the fourth pile loop is formed on the back surface of the ground substrate.

16. The method as claimed in claim 15, comprising shearing one or more of the first pile loop, second pile loop, third pile loop and fourth pile loop, resulting in one or more cut pile tufts on at least one surface of the ground substrate.

* * * * *